US008059142B2

(12) United States Patent
Handschy et al.

(10) Patent No.: US 8,059,142 B2
(45) Date of Patent: Nov. 15, 2011

(54) DIGITAL DISPLAY

(75) Inventors: Mark A. Handschy, Boulder, CO (US); James M. Dallas, Superior, CO (US); Per Harold Larson, Boulder, CO (US); David B. Hollenbeck, Frederick, CO (US)

(73) Assignee: Micron Technology, Inc., Boise, ID (US)

( * ) Notice: Subject to any disclaimer, the term of this patent is extended or adjusted under 35 U.S.C. 154(b) by 933 days.

(21) Appl. No.: 11/969,734

(22) Filed: Jan. 4, 2008

(65) Prior Publication Data

US 2010/0045690 A1 Feb. 25, 2010

Related U.S. Application Data

(60) Provisional application No. 60/939,307, filed on May 21, 2007, provisional application No. 60/883,492, filed on Jan. 4, 2007, provisional application No. 60/883,474, filed on Jan. 4, 2007.

(51) Int. Cl.
*G09G 5/10* (2006.01)
*G09G 5/36* (2006.01)

(52) U.S. Cl. ..... 345/690; 345/547; 345/549

(58) Field of Classification Search ..... 345/89, 345/549, 690, 545, 547
See application file for complete search history.

(56) References Cited

U.S. PATENT DOCUMENTS 4,087,792 A 5/1978 Asars
4,194,215 A 3/1980 Shionoya
4,427,978 A 1/1984 Williams
4,649,432 A 3/1987 Watanabe et al.
4,700,367 A 10/1987 Kawazoe et al.
4,743,096 A 5/1988 Wakai et al.
4,766,430 A 8/1988 Gillette et al.
5,162,786 A 11/1992 Fukuda
5,191,333 A 3/1993 Nakano
5,225,823 A 7/1993 Kanaly
5,412,396 A 5/1995 Nelson
5,748,164 A 5/1998 Handschy et al.
5,798,746 A 8/1998 Koyama
5,808,800 A 9/1998 Handschy et al.
5,977,940 A 11/1999 Akiyama et al.
6,100,945 A 8/2000 Crandall et al.
6,157,396 A 12/2000 Margulis et al.
(Continued)

FOREIGN PATENT DOCUMENTS

EP 1091343 A2 4/2001
(Continued)

OTHER PUBLICATIONS

M. Senda, Y. Tsutsui, R. Yokoyama, K. Yoneda, S. Matsumoto, A. Sasaki, "Ultra-Low-Power Polysilicon AMLCD with Full Integration," SID 02 Digest, 2002, pp. 790-793.

(Continued)

*Primary Examiner* — Bipin Shalwala
*Assistant Examiner* — Jonathan King
(74) *Attorney, Agent, or Firm* — Marsh Fischmann & Breyfogle LLP

(57) ABSTRACT

A display system that achieves a gamma characteristic different than 1, such as a gamma characteristic of 2 for example. The gamma characteristic may be selectable and it may be selectable via timing characteristics rather than by varying the intensity of the light source. Defective memory registers are also compensated for by selecting them to store bits of relatively lower significance.

27 Claims, 24 Drawing Sheets

U.S. PATENT DOCUMENTS

| | | | | |
|---|---|---|---|---|
| 6,175,351 | B1 | 1/2001 | Matsuura et al. | |
| 6,246,386 | B1 | 6/2001 | Perner | |
| 6,249,269 | B1 | 6/2001 | Blalock et al. | |
| 6,271,818 | B1 | 8/2001 | Yamazaki et al. | |
| 6,329,974 | B1 | 12/2001 | Walker et al. | |
| 6,340,994 | B1 | 1/2002 | Margulis et al. | |
| 6,373,497 | B1 | 4/2002 | McKnight et al. | |
| 6,441,829 | B1 | 8/2002 | Blalock et al. | |
| 6,507,330 | B1 | 1/2003 | Handschy et al. | |
| 6,525,709 | B1 | 2/2003 | O'Callaghan | |
| 6,633,301 | B1 | 10/2003 | Dallas et al. | |
| 6,727,872 | B2 | 4/2004 | Pfeiffer et al. | |
| 6,731,257 | B2 | 5/2004 | Pfeiffer et al. | |
| 7,283,105 | B2 | 10/2007 | Dallas et al. | |
| 7,483,004 | B2 * | 1/2009 | Kim | 345/82 |
| 2002/0050518 | A1 | 5/2002 | Roustaei | |
| 2002/0057236 | A1 | 5/2002 | Jacobsen et al. | |
| 2003/0025718 | A1 * | 2/2003 | Mori | 345/690 |
| 2004/0125090 | A1 * | 7/2004 | Hudson | 345/204 |
| 2004/0125094 | A1 * | 7/2004 | Hudson | 345/204 |
| 2004/0174328 | A1 * | 9/2004 | Hudson | 345/87 |
| 2004/0263502 | A1 * | 12/2004 | Dallas et al. | 345/204 |
| 2006/0244476 | A1 | 11/2006 | Zhang et al. | |
| 2007/0008272 | A1 * | 1/2007 | Li et al. | 345/100 |
| 2007/0018919 | A1 * | 1/2007 | Zavracky et al. | 345/87 |

FOREIGN PATENT DOCUMENTS

| | | | |
|---|---|---|---|
| EP | 1207512 | A1 | 5/2002 |
| EP | 1300826 | A2 | 4/2003 |
| JP | 07-092935 | | 4/1995 |

OTHER PUBLICATIONS

Hiroyuki Kimura, Takashi Maeda, Takanori Tsunashima, Tetsuo Morita, Hiroyoshi Murata, Shinichi Hirota, Hajime Sato, "A 2.15 inch QCIF Reflective Color TFT-LCD with Digital Memory on Glass (DMOG)," SID 01 Digest, 2001, pp. 268-271.

Yoshiharu Nakajima, Yasuyuki Teranishi, Yoshitoshi Kida, Yasuhito Maki, "Ultra-low-power LTPS TFT-LCD technology using a multi-bix pixel memory circuit," Journal of the SID, 2006, pp. 1071-1075.

Khella, "A Low-Power High Performance Current-Mode Multiport SRAM," IEEE Transaction on VLSI Systems, vol. 9, No. 5, pp. 590-598 (Oct. 2001).

Blalock and Jaeger, "A High-Speed Clamped Bit-Line Current-Mode Sense Amplifier," IEEE Journal of Solid-State Circuits, vol. 26, No. 4 (Apr. 1991).

European Application No. 08 71 3572 Entitled "Digital Display," International Filing Date Jan. 4, 2008, Communication Pursuant to 62 EPC dated Mar. 1, 2010.

PCT Application No. PCT/US08/50297 Entitled "Digital Display," International Filing Date Jan. 4, 2008, Notification of Transmittal of the International Search Report and the Written Opinion of the International Searching Authority, or Declaration dated Jul. 9, 2008.

* cited by examiner 110
118
pixel
electrode
PIXEL
116
pixel
driver
$V_{PIX}$
PIXCLR
PIXSET
120
TRIGGER
nTRIGGER
nHOLD
REFRESH
114
select/read +
decision logic
nPRECHG
GCOLEN
156
$S/R_q$
$S/R_1$
$S/R_0$
SELB
SELA
$OUTA_0$
$OUTB_0$
$OUTA_1$
$OUTB_1$
$OUTA_q$
$OUTB_q$
local column data
global column data
112
storage
cell pair
bit 0
bit 1
bit q
$WRITEA_0$
$WRITEB_0$
$WRITEA_1$
$WRITEB_1$
$WRITEA_q$
$WRITEB_q$
86
column
control TRIGGER
148
nHOLD
nTRIGGER
162
+V
160
+V
REFRESH
158
local column
156
GCOLEN
global column
114
152
150
+V
nPRECHG
151
154
154
154
SELB
SELA
S/R0
OUTA0
OUTB0
S/R1
OUTA1
OUTB1
S/Rq
OUTAq
OUTBq
156
156
156

| TIME STEP | SEQUENCE GENERATOR OUTPUT | | | | STORED IMAGE DATA BIT | | | | stored image data values producing TRIGGER high (central node not discharged) |
|---|---|---|---|---|---|---|---|---|---|
| | $C_3$ | $C_2$ | $C_1$ | $C_0$ | 3 | 2 | 1 | 0 | |
| 1 | 1 | 1 | 1 | 1 | E | E | E | E | 0000 |
| 2 | 1 | 1 | 1 | 0 | E | E | E | X | 0000, 0001 |
| 3 | 1 | 1 | 0 | 1 | E | E | X | E | 0000, 0010 |
| 4 | 1 | 1 | 0 | 0 | E | E | X | X | 0000, 0001, 0010, 0011 |
| 5 | 1 | 0 | 1 | 1 | E | X | E | E | 0000, 0100 |
| 6 | 1 | 0 | 1 | 0 | E | X | E | X | 0000, 0001, 0100, 0101 |
| 7 | 1 | 0 | 0 | 1 | E | X | X | E | 0000, 0010, 0100, 0110 |
| 8 | 1 | 0 | 0 | 0 | E | X | X | X | 0000, 0001, 0010, 0011, 0100, 0101, 0110, 0111 |
| 9 | 0 | 1 | 1 | 1 | X | E | E | E | 0000, 1000 |
| 10 | 0 | 1 | 1 | 0 | X | E | E | X | 0000, 0001, 1000, 1001 |
| 11 | 0 | 1 | 0 | 1 | X | E | X | E | 0000, 0010, 1000, 1010 |
| 12 | 0 | 1 | 0 | 0 | X | E | X | X | 0000, 0001, 0010, 0011, 1000, 1001, 1010, 1011 |
| 13 | 0 | 0 | 1 | 1 | X | X | E | E | 0000, 0100, 1000, 1100 |
| 14 | 0 | 0 | 1 | 0 | X | X | E | X | 0000, 0001, 0100, 0101, 1000, 1001, 1100, 1101 |
| 15 | 0 | 0 | 0 | 1 | X | X | X | E | 0000, 0010, 0100, 0110, 1000, 1010, 1100, 1110 |
| 16 | 0 | 0 | 0 | 0 | X | X | X | X | 0000, 0001, 0010, 0011, 0100, 0101, 0110, 0111, 1000, 1001, 1010, 1011, 1100, 1101, 1110, 1111 |

Fig. 10

| REGISTER ROW | DEFECT | BIT VALUE | OUTPUT SEL LINE | LATCH BANK |
|---|---|---|---|---|
| 0 | | G7 (MSB) | 0 | 00000 |
| 1 | | R7 (MSB) | 1 | 00001 |
| 2 | | B7 (MSB) | 2 | 00010 |
| 3 | x | G6 | 4 | 00100 |
| 4 | | R6 | 5 | 00101 |
| 5 | | B6 | 6 | 00110 |
| 6 | | G5 | 8 | 01000 |
| 7 | x | R5 | 10 | 01010 |
| 8 | | B5 | 11 | 01011 |
| 9 | x | G4 | 13 | 01101 |
| 10 | | R4 | 14 | 01110 |
| 11 | | B4 | 15 | 01111 |
| 12 | x | G3 | 16 | 10000 |
| 13 | | R3 | 18 | 10010 |
| 14 | | B3 | 19 | 10011 |
| 15 | | G2 | 20 | 10100 |
| 16 | | R2 | 21 | 10101 |
| 17 | x | B2 | 22 | 10110 |
| 18 | | G1 | 23 | 10111 |
| 19 | | R1 | 17 | 10001 |
| 20 | | B1 | 12 | 01100 |
| 21 | | G0 (LSB) | 9 | 01001 |
| 22 | | R0 (LSB) | 7 | 00111 |
| 23 | | B0 (LSB) | 3 | 00011 |

FIG. 25

DIGITAL DISPLAY

CROSS-REFERENCE TO RELATED APPLICATIONS

This application claims priority from U.S. Provisional Patent Applications Nos. 60/883,492 filed Jan. 4, 2007, entitled "Digital Display", 60/939,307 filed May 21, 2007, and also entitled "Digital Display," and 60/883,474 filed Jan. 4, 2007, entitled "Charge-Control Drive of Ferroelectric Liquid Crystals", the contents of each of which are incorporated herein by reference.

Some aspects of this invention were made with Government support under contract FA8650-04-M-5443 awarded by the United States Air Force Research Laboratory. The Government has certain rights in the invention.

BACKGROUND OF THE INVENTION

Some types of electronic displays require that input image data, when supplied by a standard video signal, be reformatted, re-ordered, or re-sequenced prior to display. Examples is include sequential-color displays and displays, like plasma displays, that use certain kinds of digital gray scale. The reformatting or conversion allows the display to operate in the simplest way while maintaining compatibility with legacy video standards. However, the data reformatting or conversion results in a need to pass a great deal of data to the display in a very short period of time if video image quality is to be maintained. The image data may typically have been stored in a frame buffer external to the display. Passing such large amounts of data to the display has numerous practical disadvantages. High data rates necessitate display electronic interconnection with high I/O pin counts that in turn increase display system production cost. Further, high data rates result in undesirably high display power dissipation. It would be desirable therefore to be able to display high-quality video images, even on displays that best operate on input image data in an order different than that of current video standards, without having to pass large amounts of data at high rates through the conversion or reformatting system and on to the display. These concerns about display system power consumption, interconnect size, bandwidth, and cost are heightened in many applications that use microdisplays, since the very nature of the application often stresses portability, compactness, and battery life. A "microdisplay" is a display that is magnified for viewing (whether by projection of an image larger than the microdisplay onto a more or less distant screen, or by the production of virtual image viewed with the display near to the eye), particularly when implemented on an integrated-circuit backplane utilizing semiconductor substrates or thin films.

To date, most "digital" displays (displays that vary some variation of a temporal characteristic of a digital signal driving or controlling a pixel's optical modulation or light-emitting means to achieve variation of the gray shade displayed by that pixel) have either had a very minimum amount of data storage at each pixel (for example 1 or 2 bits), or, if they utilized more storage per pixel, have still relied on data processing external to the pixel to such a degree that high bandwidth, high-power-consumption data transfer to and across the microdisplay was still required. On the other hand, many inventors and engineers have described more sophisticated hypothetical microdisplay architectures that have not yet found commercial application that rely on in-pixel circuitry so complex that the resulting pixel would be so large that a high-resolution microdisplay could be made only with a silicon backplane of prohibitive cost.

Dynamic random access memory (DRAM) has found only limited use to store image data in microdisplays. One reason for this is that DRAM registers only retain their data for a short, finite time. The amount of time varies from register to register or cell to cell due to inevitable variations in the silicon fabrication process. Cells that are unable to retain the data therein beyond some specified retention time may be considered to be defective. Because a DRAM memory requires periodic refresh and because it will typically have a significant, non-zero number of defective cells, such a memory architecture has heretofore been considered undesirable for storing of image data to be displayed.

Another difference between most digital displays and their historical antecedents is their gamma characteristic, which is the exponent of a power-law relationship between display brightness and input image value. Cathode ray tube (CRT) displays typically have a characteristic with a gamma value of 2 or a bit more. Digital displays, on the other hand, to date have typically been characterized by values of gamma ($\gamma$) essentially equal to 1. Providing a display with gamma values close to those of historical displays is important for a number of reasons. First, standard video cameras continue to have gamma values around 0.45, ensuring compatibility with the installed base of video displays. Second, legacy image and video recordings, whether analog or digital, require displays with $\gamma \approx 2$ for proper replay. Third, in the case of digital or quantized video signals and image representations, it turns out that a gamma characteristic with $\gamma \approx 2$ better matches the characteristics of human perception than does a gamma characteristic with $\gamma \approx 1$. It is desirable for the brightness steps in a display that result from numerically adjacent input data to have a constant perceptual spacing. Unfortunately, for displays having $\gamma \approx 1$, the perceived brightness steps are small at the high-brightness end of the grayscale but large at the low-brightness end, which produces perceptible and objectionable contouring of brightness gradients in the dark parts of displayed scenes. For displays having $\gamma \approx 2$, the perceived brightness steps are much closer to equal across the gray scale, and the contouring is greatly reduced. In some commercial digital displays this undesirable characteristic has been compensated for with extra bits of data. For example, standard eight-bit input image data can be mapped to the 10-bit values of a $\gamma \approx 1$ gray scale that are closest to the originally desired output value. Two to four extra bits of gray-scale data per color to make 10-12 bits/color is generally thought to provide an image on a display having a gamma characteristic of 1 that is roughly equivalent to an 8-bit/color image displayed on a display with a gamma characteristic of 2. However, the use of extra bits increases the amount of data storage registers needed to make a frame buffer, and it increases the needed bandwidth to transport the image data onto the microdisplay.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects of thereof are described and illustrated in conjunction with systems, tools, and methods which are meant to be exemplary and illustrative, and not limiting in scope. In various embodiments, one or more of the above-described problems have been reduced or eliminated, while other embodiments are directed to other improvements.

A display includes an array of pixels that can be driven to different optical states and a clock that generates a signal that is used to control the optical state of each pixel in the array of pixels, wherein the signal is varied to achieve a gamma characteristic different than 1.

The display may further include a light source to illuminate the array of pixels, wherein the light source is not varied in intensity to achieve a non-unity gamma characteristic. The achieved gamma characteristic may be greater than 1. The achieved gamma characteristic may be approximately 2. The achieved gamma characteristic may be programmable.

A display includes an array of pixels that can be driven to different optical states and a light source to illuminate the array of pixels. The display panel provides a gamma characteristic different than 1 without varying the intensity of the light source to achieve a gamma characteristic different than 1.

The display further includes a clock that generates a signal that is used to control the optical state of each pixel in the array of pixels to drive the pixels, wherein the signal is varied to achieve a gamma characteristic greater than 1.

A digital display includes an array of pixels, each having a selectable optical state and a plurality of logic circuits that each receive a pair of digital inputs and provide an output signal based on 1 the digital inputs, wherein the optical state of each pixel is based at least in part on the output signal, wherein each such logic circuit is shared by a number of pixels, the number being between and including 1 and 24.

One of the digital inputs may be representative of a ramp value. One of the digital inputs may be representative of a pixel value.

The digital display may further include other logic circuits that are shared by more than 24 pixels. The array of pixels may include significantly more rows of pixels than 48. Each pixel may include no more than 700 transistors, no more than 500 transistors, no more than 300 transistors, no more than 20.0 transistors, or no more than 150 transistors.

Each pixel may store more than 2 bits of image data, more than 8 bits of image data, more than 24 bits of image data, or 48 bits of image data.

A digital display includes an array of pixels and a frame buffer that stores image data for the pixels therein.

The display may include memory registers therein that indicate the rows within the frame buffer that have a defect therein. The display may arrange for relatively lower significant bits of the image data to be stored in the rows within the frame buffer that have defects. The display may arrange for portions of the frame buffer with defective cells to contain data for less easily perceived color than green. The frame buffer may be tested to determine the rows within the frame buffer that have a defect therein and information indicative of those rows is stored in the memory registers. The polarity of the stored image data may be selected to be such that a defect causes a pixel to provide less light than would be displayed by the pixel if there were no defect.

A method of operating a digital display includes providing a display have an array of pixels and a frame buffer; identifying the rows within the frame buffer that have one or more defects; storing information indicative of which rows have the defects; using the stored information to place relatively lower significant bits of image data in the rows within the frame buffer that have defects.

The method may further include selecting the polarity of the stored image data to be such that a defect causes a pixel to provide less light than would be displayed by the pixel if there were no defect.

A digital display includes an array of pixels having M columns of pixels and N rows of pixels and a clock that generates a clock signal that is provided to the array of pixels to drive the pixels, wherein the rate of the clock signal is no greater than (equation that is a function of M,N).

The clock rate may be kept relatively low by writing data to each pixel only once for each frame of data to be displayed.

A digital display includes an array of pixels having M columns and N rows, the pixels including circuitry therein that converts stored data representative of the optical state to be displayed by the pixel into a drive signal for the pixel, wherein M is at least 400 and N is at least 250.

A digital display includes an array of pixels having M columns and N rows, the pixels storing data therein that is representative of the optical state to be displayed by the pixel, wherein each pixel includes no more than 700 transistors, wherein M is at least 400 and N is at least 250

In addition to the exemplary aspects and embodiments described above, further aspects and embodiments will become apparent by reference to the drawings and by study of the following descriptions.

BRIEF DESCRIPTION OF THE DRAWING

Exemplary embodiments are illustrated in referenced figures of the drawings. It is intended that the embodiments and figures disclosed herein be considered illustrative rather than limiting.

FIG. 10 is a table showing the pixel values that are matched for a particular position in the digital RAM.

FIG. 25 is a table illustrating an exemplary remapping that could be effected by the circuitry of FIG. 24.

DETAILED DESCRIPTION

Figure 1:
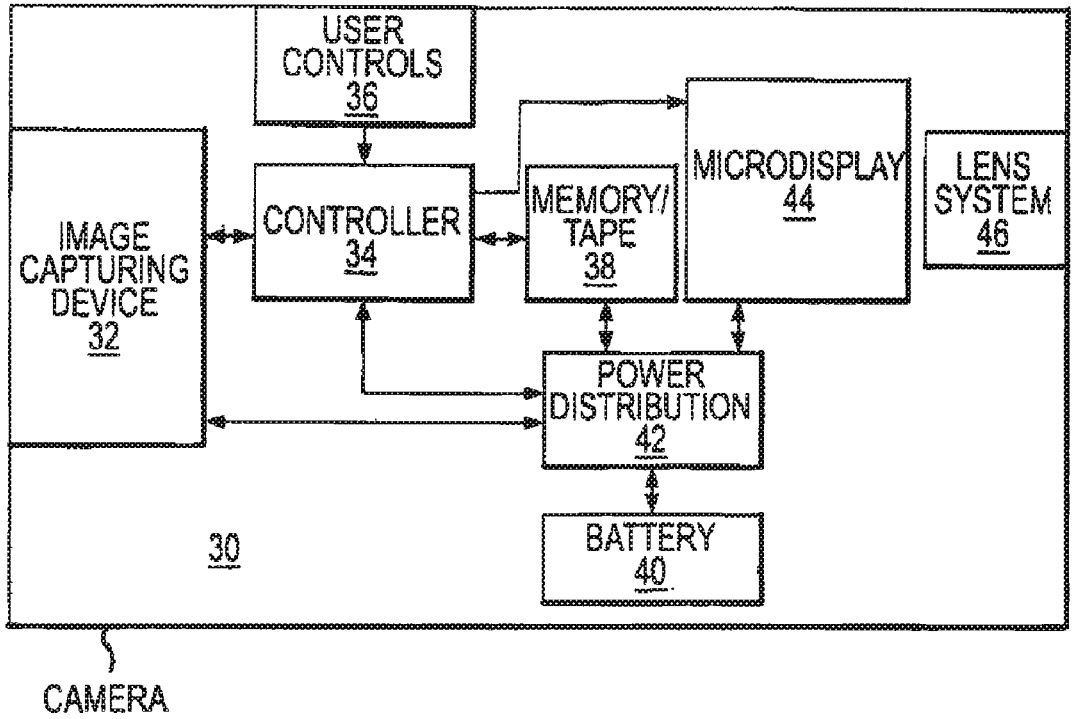
FIG. 1 is a block diagram of a camera in which the digital display could be employed.

Reference will now be made to the accompanying drawings, which assist in illustrating the various pertinent features of the present invention. Although the present invention will now be described primarily in conjunction with a reflective ferroelectric liquid crystal (FLC) microdisplay, it should be expressly understood that the present invention may be applicable to other digital display applications such as plasma display panels (PDPs), micromechanical display panels and microdisplays, organic LED display panels and microdisplays, and digitally-driven, analog-responding nematic displays and microdisplays and/or to other applications where it is desired to produce a digital gray-scale drive waveform or to utilize frame buffers or memory registers storing image data which may be susceptible to failure. In this regard, the following description of a reflective FLC microdisplay is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain modes known of practicing the invention and to enable others skilled in the art to utilize the invention in such, or other embodiments and with various modifications required by the particular application(s) or use(s) of the present invention.

In the case of displays generating field-sequential color images, current commercially available products typically include a separate interface chip upstream of the microdisplay to convert the incoming standard video image data into an acceptable format for the display. For example, a standard digital video image signal may first provide red data, green data, and blue data for a first pixel (picture element). This will be followed by red, green, and blue data (RGB data) for the next pixel and so forth. This is continued for each of the pixels in a particular line in the image, followed by the next line in the image, and so forth. The data is typically delivered at an almost even rate throughout the time allotted for the display of a frame, except for short horizontal blanking intervals at the end of each line and a short vertical blanking period at the end of each frame. For example, in the CCIR 601 and CCIR 656 standard video signals, the horizontal blanking occupies approximately 17% of the time allotted to each line (which time is on the order of 60 μs), while the vertical blanking occupies approximately 8% of the frame time. The remainder of the time, data is being delivered for display. Field sequential color displays, on the other hand, typically require first the red data for each of the pixels in the image, followed by the green data for each of the pixels in the image, followed by the blue data for each of the pixels in the image. In the simplest sequential-color display illumination schemes the entire display is illuminated with a single color primary at one time. In this case, all the data corresponding to a given primary color is best written to the pixels before the illumination commences, which further aggravates the data-supply problem, requiring that the data be provided to the display at a high rate for a short interval of time to avoid unduly reducing the illumination duty factor. For these reasons, field-sequential color display systems require additional circuitry to receive the data in one format and supply it to the display in a different format. This format conversion or data re-sequencing necessarily requires a considerable amount of buffer memory—at least the substantial fraction of a buffer capable of storing all the red, green, and blue data for all the pixels in the displayed image. With moving images, additional buffer memory is required to prevent the "tearing" artifact resulting from the display being refreshed from a single frame buffer that is simultaneously being updated with a new incoming frame. A depicted object may be moving (horizontally, for example), which causes its position to change from frame to frame. Since the image on the display is changed at a rate that is different (i.e. three or more times higher) than the rate at which new video frames come in, these two operations cannot be entirely synchronized, and it is therefore unavoidable that portions of the image data corresponding to a present frame and to a previous frame appear simultaneously on different regions of the display. Horizontal lines along which there is a mismatch in the position of the displayed object separate these regions. The object's details or texture will appear to be "torn" along these lines. This artifact is quite obvious and objectionable to the average viewer. Avoiding it requires double buffering the image data, i.e., using one buffer memory to store and display the previous frame, while a second buffer memory is updated with incoming image data. The role of the two buffers can be reversed between incoming frames.

In many digital gray scale and sequential-color schemes the average rate at which data is read-out from the frame buffer exceeds the input rate. For sequential-color systems, displaying color fields at just three times the standard video frame rate (i.e. at 150 Hz for a 50 Hz frame rate or at 180 Hz for a 60 Hz frame rate) produces color break up. This can be dramatically reduced by increasing the color field rate. Typical color sequential systems that rely on a color wheel today utilize field rates 2, 4, or even 6 times higher than the 150-180 Hz minimum. Bit-plane-type gray scale schemes, used in plasma displays and in the Texas Instruments DLP displays, produce an artifact called dynamic false contouring. This artifact can be overcome by "splitting" the display of the more significant bit planes into multiple non-contiguous intervals which are distributed throughput the video field time. For example, in the color-sequential bit-plane gray-scale scheme taught by Akimoto and Hashimoto in "A 0.9-in UXGA/

HDTV FLC Microdisplay," published in the 2000 SID International Symposium Digest of Technical Papers, Jay Morreale, editor (Society for Information Display, San Jose, Calif., 2000) pp. 194-197, each pixel is addressed 108 times during the display of one video frame to achieve display of three colors of 8-bit/color standard input data. This requires a readout rate 4.5 times higher than the input data rate.

One way to provide the needed additional data reformatting or reordering and image buffer circuitry practiced in the art is to supply it on semiconductor chips separate from the display. A disadvantage of this separate interface chip approach is the increased cost due to the need for the display system to have additional chips, for example one extra chip for the data format conversion and another dedicated to image buffering memory. Another disadvantage is the increased size of a multiple-chip display system. A further disadvantage is that the need to support higher bandwidth between the frame buffer and the display means that the display must have a larger number of connections or "pins" that it otherwise would. Finally, off display buffering further requires high-bandwidth communication between the buffer chip and the display, which invariably produces increased power consumption.

In the case of a microdisplay, an alternative location for the needed circuitry and buffer memory is on the microdisplay backplane itself, perhaps within the pixel array. However, the large amount of backplane circuitry required to effect image buffering limits practical implementations, since it tends to make the resulting backplane large and hence expensive. If the frame buffer were simply a memory block separate from the pixels, but still on the microdisplay backplane, the ratio of pixel array area to total backplane area would be undesirably reduced, since it would be impractical for the pixels to cover the memory block is area. Alternatively, the circuit architecture of the microdisplay pixels could be designed so that the needed buffer memory for a given pixel was part of the circuitry physically associated with and underneath that pixel. Although this does not solve the overall backplane size problem, it does avoid the unfavorable active-area ratio problem of a separate memory block, since the pixels now cover the memory circuits. However, this benefit comes at the price of introducing another substantial problem. The failure of any of the memory registers produces visible pixel defects. Redundancy techniques used in the semiconductor memory art to improve yield by "mapping" around the address of defective registers cannot easily be used to compensate for such pixel failures, since a detective pixel at one location cannot be replaced by a functioning pixel at a different location.

The impracticality of prior-art techniques for providing the desired fully digital sequential-color format conversion entirely within a microdisplay backplane can best be illustrated by examples. For purposes of illustration, consider a microdisplay capable of displaying full color, in a field-sequential mode, with eight bits of gray scale per color. Consider further that the microdisplay utilizes a double image buffer, with the buffer circuitry located within the pixel, to eliminate visual artifacts and to allow high color field rates. Although the layout size of an arbitrary pixel circuit cannot be determined exactly without carrying out a complete design, its lower bound can be estimated by assuming that its transistors are laid out with the same density as transistors in a standard six-transistor SRAM cell. Given that the design rules and layout for standard SRAM cells are highly optimized, it is very unlikely that arbitrary pixel circuits could be laid out with higher transistor density. In a survey of leading CMOS silicon foundries performed by the applicant, it was found that the area of optimized six-transistor SRAM cells offered by the foundries was generally larger than 130 $f^2$, where f designates the CMOS process ground rule (usually the finest feasible half-pitch for polysilicon lines in the specified process). For example, in a 0.35 μm CMOS process, six-transistor SRAM cells generally had areas of about 16 $\mu m^2$. The formula $a=130\ f^2$ produces an estimate of SRAM area a slightly larger than that estimated for future processes and future years in the "International Technology Roadmap for Semiconductors 2002 Update", sponsored by (among others) the United States' Semiconductor Industry Association.

In-pixel buffering and re-ordering of image data could conveniently be accomplished with shift registers, as is known in the sequential-color display art. Standard static CMOS shift register cells comprising two static latches (each latch further comprising four transistors in the form of cross-coupled inverters) and two transmission gates (each transmission gate comprising two transistors) require twelve transistors per stored bit. Thus, double-buffering 24 bits of image information requires 48×12=576 transistors. If these transistors could be laid out with a density matching that of the highly optimized standard SRAM cells, they would occupy 1536 $\mu m^2$ in a 0.35 μm CMOS process. Thus, just the transistors associated with the image buffer would limit the minimum achievable pitch of square microdisplay pixels to 39.2 μm for this candidate CMOS process. It is known in the sequential color display art that a stored digital image value can be converted to a pixel-duration signal (in effect, a PWM drive signal) by using a down counter. Each stage of the counter can be conventionally implemented using a half-adder and a master/slave flip-flop, with a NAND gate to detect the zero condition. The half-adder includes an eight-transistor XOR gate plus a four-transistor NAND gate, the master stage includes four transistors arranged as cross-coupled inverters plus a load transistor and an enable transistor; the slave stage is the same, minus the load transistor. The NAND gate requires two transistors per input. Thus, the counter requires 25 transistors per bit, which, for an eight-bit gray scale translates into a total of 196 transistors, after four transistors in the unused AND gate at the zeroth stage of the counter are discarded. In total, then, this double-buffered PWM implementation of 24-bit color display requires 576+196=772 transistors per pixel. This estimate ignores miscellaneous transistors needed for pixel selection, and so on. In the aforementioned 0.35 μm CMOS process, this 772-transistor pixel would require-more than 2050 $\mu m^2$, which would make the smallest achievable square-pixel pitch 45 μm.

Simpler implementations that use standard SRAM cells for the frame buffer are still problematic. To fit the 48 registers needed to double-buffer standard color video data under a 12 μm pixel would require that each register occupy no more than 3 $\mu m^2$. According to the aforementioned survey of silicon foundry capability, a standard SRAM cell occupies an area of about 130 $f^2$. Thus, obtaining a register with area less than 3 μm2 would require a CMOS process finer than 0.15 μm. To make provision for other needed circuitry such as sense amplifiers and pixel drive circuitry would necessitate further reducing the area allotted to memory registers at the expense of a still-finer CMOS process. Dropping to a 0.13 μm process would probably not be sufficient: a 90 nm or finer process would likely be required. Such fine processes have high associated design and manufacturing costs, resulting in undesirably expensive microdisplay backplanes. Although DRAM registers have implementations more compact than standard SRAM cells, DRAM registers have reduced tolerance to variation of transistor parameters such as leakage, and hence tend to have higher failure rates, especially when implemented not in a specialty DRAM process but in a standard logic process as are most microdisplay backplanes. The display-specific difficulties in using redundancy techniques common in the memory art to map around defective registers has made DRAM registers an unattractive alternative to SRAM registers for pixel-based frame buffers.

This pixel size estimate can be contrasted with pixel pitches found in current commercial microdisplays, which range downwards from around 13 μm to certainly as small as 7 μm. Thus, straightforward implementation of digital sequential-color format conversion results in pixels with areas more than 10 times larger than is commercially competitive. For a given display resolution, a large pixel size results in a large backplane die size, which correspondingly results in few backplane die per silicon wafer and low backplane die yield, compounding to give an undesirably high backplane die cost.

Outside of the limitations imposed by pixel and buffer size are other limitations imposed by power dissipation. Conventional memory architectures, whether SRAM or DRAM, rely on sense amplifiers located peripheral to the array of registers. For a frame buffer located under the pixels of a microdisplay, such an arrangement requires charging a wire of length comparable to the size of the display each time a bit is read from the buffer. This technique was employed in a microdisplay architecture disclosed in U.S. Pat. No. 7,283,105, which describes a microdisplay backplane with integrated frame buffer capable of accepting standard raster-order video signals and displaying in color sequential mode. The architecture in this disclosure comprises an array of SRAM registers largely beneath an array of pixel electrodes. To help overcome the size limitations discussed above, this architecture utilized a lossy compression scheme whereby the frame buffer stored a representation of the image that was compressed by a factor two—e.g. a standard 24-bit/pixel input image representation could be stored as a 12-bit/pixel representation, halving the number of registers required. Digital gray scale was implemented using pulse-width modulation (PWM), which required reading back the 12-bit stored image data for each pixel on each of $2^G-1$ time steps per color field, where each color had G=8 bits of gray scale. The frame buffer was organized so that it each pixel had three rows and eight columns of registers, the 24 registers/pixel allowing double buffering of the 12-bit image representation. Only half of the pixel's eight columns were read out during a given frame. Thus, the total number of read operations per color field in this architecture was equal to $(2^G-1)(3Y)(4X)$, where the display has X columns and Y rows of pixels. The gray-scale value for each of the three colors was displayed four times during one video frame; thus the color field rate was for 60 Hz video input was 720 fields/sec. The capacitance $C_B$ of the element of bit-line (column wire) length associated with each register was about 1.2 fF; thus, the total capacitance of each complete bit line was $3YC_B$. (three rows of register per each of Y rows of pixels). A bit-line voltage swing of $V_S$=0.28 V was sufficient for sense amplifiers at the ends of the columns to complete a readout; thus, the energy $C_BV_S^2$ associated with charging one register's piece of bit-line was about 0.1 fJ. In this case the power P associated with gray-scale display based on the readout all X columns of the stored image was equal to $$P=[(2^G-1)\cdot 3Y\cdot 4X]\cdot 720\cdot 3YC_BV_S^2\cdot(1/2)=(0.1\text{ fJ})(12960\text{ Hz})(2^G-1)XY^2,$$

the final factor of ½ coming from a statistical assumption that with an equal number of ones and zeroes stored in the frame buffers the bit-line will change state on only half of the reads.

For displays of a given aspect ratio, for example X:Y=4:3, the power scales as the cube of the number Y of rows, leading to high power dissipations for high resolution displays. For example, with the above parameters, the readout of a quarter-VGA display (X=320, Y=240) with 8-bit gray scale would consume only 6.1 mW, but the readout of a 1280×960 display would consume 64 times as much, or 390 mW. The power consumption associated with frame buffers implemented as external chips may not scale exactly the same as described above for a frame buffer implemented on a microdisplay backplane, but in general the interconnect capacitances in the case of the external frame buffer will be higher as will the corresponding power dissipation. Power dissipation for high-resolution external-frame-buffer microdisplay systems known in the art is measured in multiple watts.

A consideration of the timing of the readout operations illustrates another very important limitation on frame-buffer architectures for pixel arrays. As detailed in the above example, each column of registers is read out $(2^G-1)(3Y)$ times per color field. For the quarter-VGA display with 720 Hz field rate, the amounts to a read time of 7.6 ns. To implement the same gray-scale and color-sequential scheme on a 1080-line display reduces the time allowed for a read to 1.7 ns (a read rate of 600 Mb/s on each column). It would be very difficult to accomplish this with columns having a total capacitance of nearly 4 pF while keeping the detection voltage for the sense amplifier as low as 0.28 V.

In summary, while it is desirable to implement on a single pixel-array-sized substrate low-power microdisplays that accept input video data in the standard pixel-by-pixel order, but perform digital gray scale and color-sequential display techniques by utilizing the input data in an order different from that supplied. However, the factors described above have prevented this until now. Straightforward partition of the substrate into a pixel array surrounded by memory blocks requires a larger-than-necessary substrate and results in a microdisplay with higher-than-desired power consumption. Placing SRAM registers under the pixels (rather than outside the perimeter of the pixel array) can reduce the size of the substrate, but still requires substantial area outside the pixel array unless expensive nanometer-scale CMOS processes are used, and still leaves power consumption unaffected. Substituting DRAM for SRAM can reduce the area overhead associated with the frame buffer, but at the penalty of more complicated sense circuitry and a higher defect rate. The lowest power consumption comes from reducing the distance between frame buffer memory registers and their destination pixels to size of the pixel or a few times that. The resulting association between a register and the pixel that displays its data imposes the need for very effective error correction or fault tolerance techniques if the display is not to be marred by many visually defective pixels. At the same time it precludes the use of error correction and fault tolerance techniques known in the art since the size of the circuit block on which they must work comprises one or only a few pixels and thus at most a few hundred registers—any circuit employed in such a small block must be extremely simple to not dwarf the few pixels and registers it serves.

System Elements

With the above difficulties in mind, we can now discuss the present invention. One example of an application in which the present invention may be employed is a camera 30, as shown in FIG. 1. The camera 30 may be a video camera, a digital still camera, or another type of camera or imaging device. The camera 30 may include an image-capturing device 32 that is capable of creating electrical signals representative of an image that a user may desire to record. The electrical signals are passed from the image-capturing device 32 to a controller 34 which controls the function of the camera 30. The camera 30 also includes user controls 36 that the user may use to select modes of operation of the camera 30. The controller 34 has the ability to store the electronic signals representative of the images in a storage device such as memory/tape unit 38. In the case of a video camera this memory unit 38 may typically be a videotape or disk drive, while in the case of a digital still camera this may typically be some type of electronic, non-volatile memory (e.g., flash memory). The camera 30 also includes a battery 40 that supplies power to the components of the camera 30 via a power distribution unit 42. The stored electronic representation of the images can be converted to visual images by a microdisplay 44 that may be viewed by the user via a lens system 46 or reflective magnifier (not shown). While this is one example of an application in which the microdisplay of the present invention may be utilized, it is only exemplary in nature and is not intended to limit in any fashion the scope of the invention.

Figure 2:
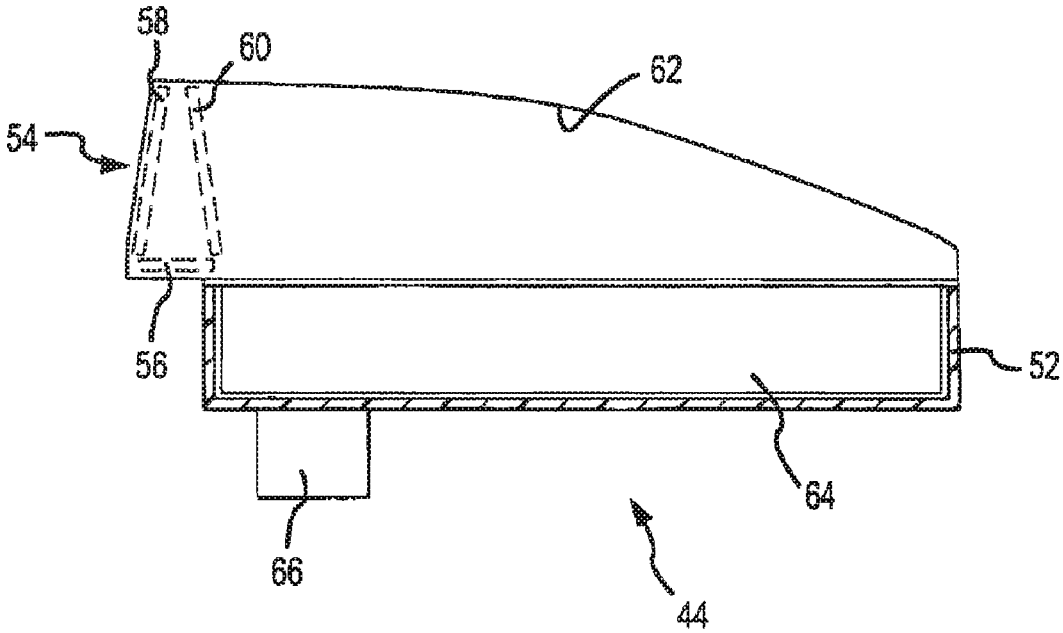
FIG. 2 is a side view of the digital display showing a portion of the packaging cut away to reveal an LCOS (liquid-crystal-on-silicon) unit of the digital display.

The microdisplay 44 is shown in FIG. 2 to illustrate its major components. The microdisplay 44 includes a plastic package housing 52 to which an illuminator housing 54 is attached. The illuminator housing 54 houses a light source 56, which could be, for example, tri-color light-emitting diodes (LED), and a reflector 58 that collects light emitted by the light source x56. Any other suitable type of light source could also be employed. The light then passes through a pre-polarizer and diffuser 60 to minimize stray light of unwanted polarization and to create even illumination. The diffuse, polarized light is directed toward a polarizing beam splitter (PBS) 62, which reflects light of one linear polarization while rejecting light of an orthogonal linear polarization. The reflected light is directed down toward a liquid crystal on silicon (LCOS) display panel 64 that resides in the package housing 52. As will be described in further detail below, the display panel includes an array of pixels that can be electronically controlled into different light-modulating states. In one light-modulating state, the incoming polarized light is reflected back toward the PBS 62 with the same polarization. In another light-modulating state, the light is reflected back toward the PBS 62 with its linear polarization rotated by 90°. As can be appreciated, the PBS 62 will reflect the reflected light that has not had its polarization rotated back towards the illuminator, while the light that has been rotated in polarization will pass through the PBS 62 for viewing by the user via the lens system 46. A connector 66 depends downward from the package housing 52 for electrical connection to the camera 30 such as via a flex cable.

The above discussion of the operation of the display panel 64 is not intended to limit the present invention, as other types of spatial light modulators could also be utilized in the present invention, such as spatial light modulators depending on miniature mechanical mirrors, for example. A variety of different kind of light sources could be used with spatial light modulator (SLM) displays. For sequential color SLM displays the light source could preferably be made of red, green, and blue light emitting diodes, either organic or inorganic. Alternately, the light source could be made of red, green, and blue lasers, particularly semiconductor lasers or solid-state lasers. Also, display panels that emit their own light could be used. In addition, while the discussion involves linearly polarized light of two different orthogonal directions, it is also possible to utilize the present invention in a system in which unpolarized light or different types of polarization are used. Further details on the operation of liquid crystal spatial light modulators can be found in U.S. Pat. Nos. 5,748,164, 5,808,800, 5,977,940, 6,100,945, 6,507,330, 6,525,709, and 6,633,301, and in U.S. Patent Publication No. US200410263502, the contents of each of which are incorporated herein by reference.

Display Panel Detail

Figure 3:
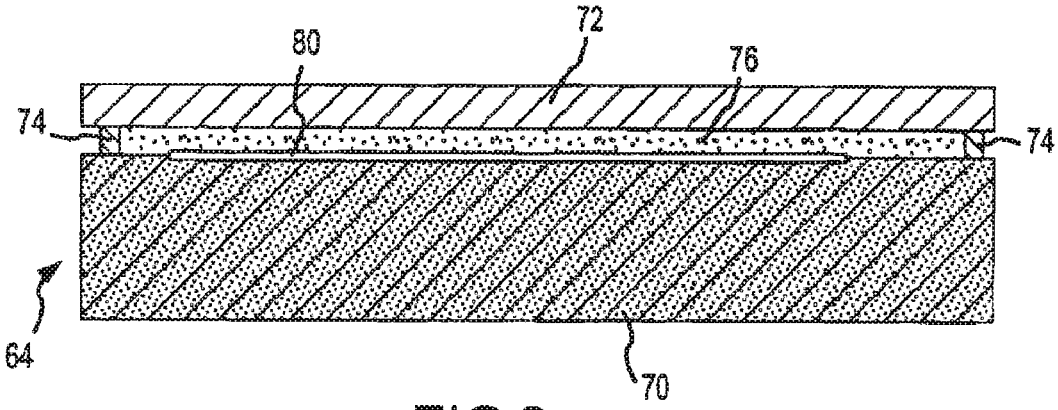
FIG. 3 is a cross-sectional view of the LCOS unit of FIG. 2.
Figure 4:
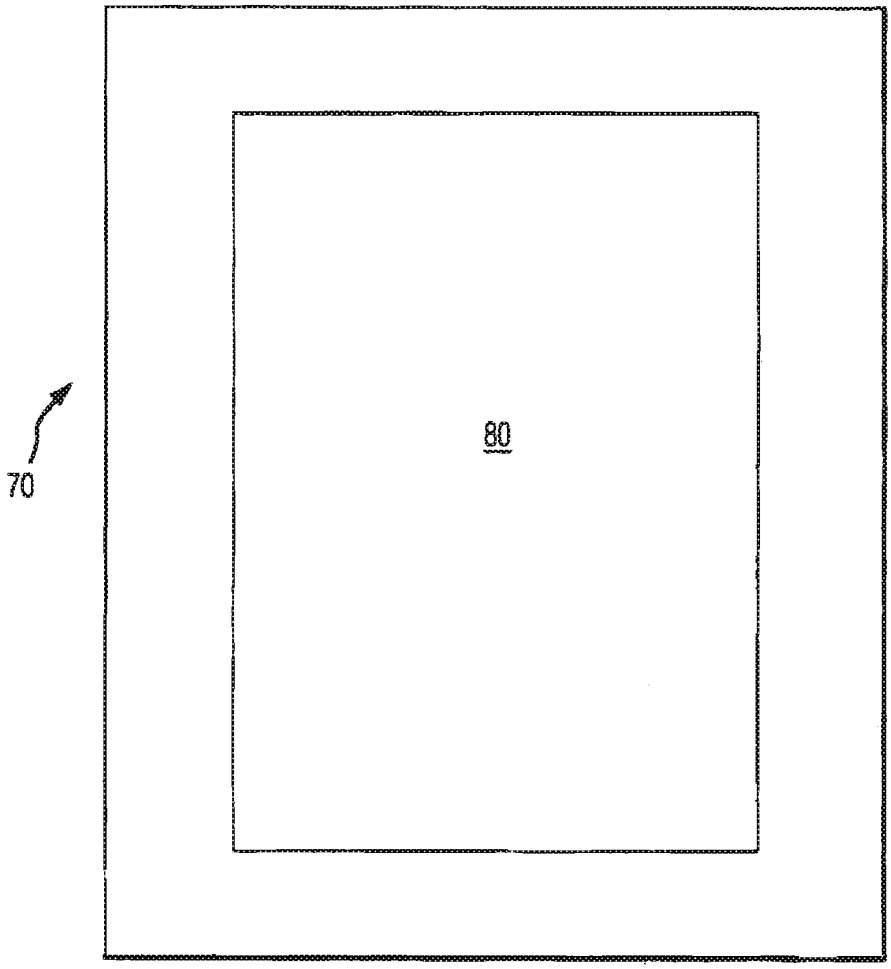
FIG. 4 is a top view of the silicon backplane of the LCOS unit of FIG. 2.

The display panel 64 is shown in greater detail in FIGS. 3 and 4. As shown in FIG. 3, the display panel 64 includes a silicon backplane 70 to which a sheet of glass 72 has been affixed via glue seal 74. Sandwiched between the silicon backplane 70 and the sheet of glass 72 is a layer of liquid crystal material 76. Although not illustrated in this view, the glass 72 and the backplane 70 are offset slightly in one direction to allow there to be a slight overhang of glass on one side and a slight overhang of silicon on the opposite side. Many layers are not shown in FIG. 3, for ease of illustration. For example, without limitation, there may be a conductive window electrode located on an inner surface of the glass 72, there may be alignment layers on either side of the layer of liquid crystal material 76, and there may be various antireflective layers, as well as many other layers.

The liquid crystal material 76 may include any of several types of liquid crystals including, but not limited to, ferroelectric, nematic, or other types of liquid crystals. In this embodiment, ferroelectric liquid crystals (FLC) are utilized. In the FLC embodiment, it is advantageous to use FLC materials that are multi-component component mixtures. The mixtures may comprise an achiral host mixture plus chiral dopants that provide, for example, a desired magnitude of spontaneous polarization, and provide separate compensation of the nematic-phase and smectic-C*-phase helical pitches. Appropriate design of the mixture formulation provides a wide-temperature smectic C* phase, preferably having a low freezing point and a high melting point. Freezing points below −10° C., or even below −20° C., or even below −30° C. are desirable, while having the temperature at which the smectic C* phase melts to the next less-ordered phase above +60° C. is preferred, with melting temperatures above +70° C. or even +80° C. are more preferred. Selection of low-viscosity host mixtures formulated with appropriate dopants provides suitable FLC materials with switching times at room temperature with drive voltages of ±5 V of less than 300 μs, or even less than 200 μs, desirably with drive voltages less than ±2 V.

Alternatively, other types of display devices such as digital micromirror and other microelectromechanical (MEMS) devices, plasma displays, electroluminescent displays, organic or inorganic light-emitting diodes, and the like could be employed as part of the display panel. As can be appreciated, these alternatives may either be spatial light modulators, either transmissive or reflective, that modulate light from a light source or they may be light emissive devices that do not require a separate light source.

The silicon backplane 70 includes an area on a top surface thereof where an array 80 of reflective pixel electrodes is located. As can be appreciated, the image is formed in this area of the display panel 64, which is known as the "active area" of the display panel. The silicon backplane 70 is shown in FIG. 3 as a undifferentiated block solely for ease of illustration of the major components of the display panel 64. In actuality, a plurality of circuits, conductors, and so forth exist within the silicon backplane 70, as will be discussed in further detail below.

Figure 5:
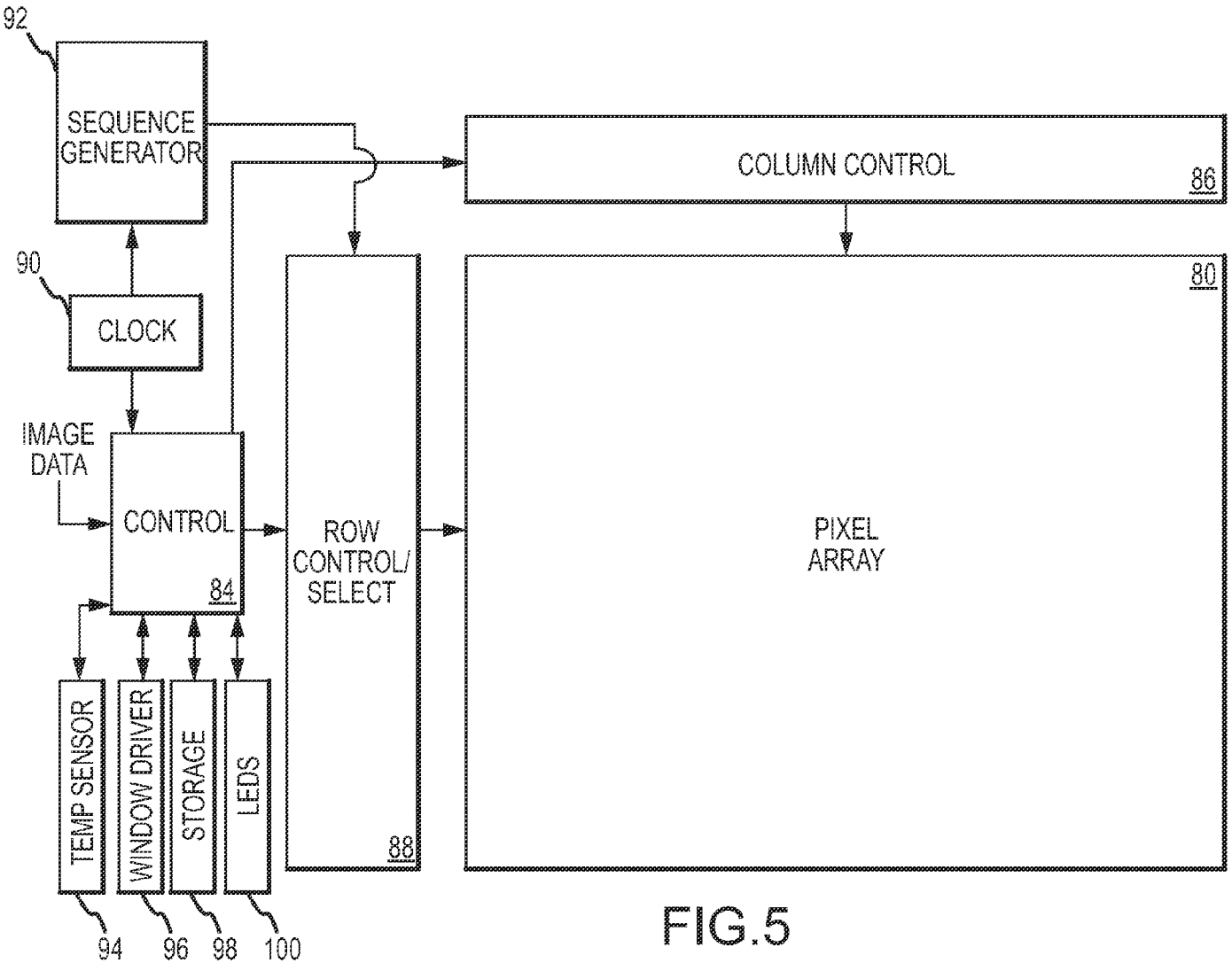
FIG. 5 is a block diagram of portions of the silicon backplane of FIG. 4.

The display panel 64 is illustrated in further detail in FIG. 5. As can be seen, image data is provided to a control unit 84 which generally provides the image data to a column control unit 86 and control/select information to a row control unit 88. In turn, the column control unit 86 and the row control unit 88 control the display of image information by the array of pixels 80. A clock 90 provides a signal to the control unit 84 and to a sequence generator 92. The sequence generate 92 provides a sequence of digital words to the row control unit 88 which provides it further to the pixel array 80.

The control unit 84 may also interface with several other devices, not all of which are shown in FIG. 5. Examples of these devices are a temperature sensor 94, a window electrode driver 96, a data storage device 98 (e.g., an EEPROM), and light source 100.

Figure 15:
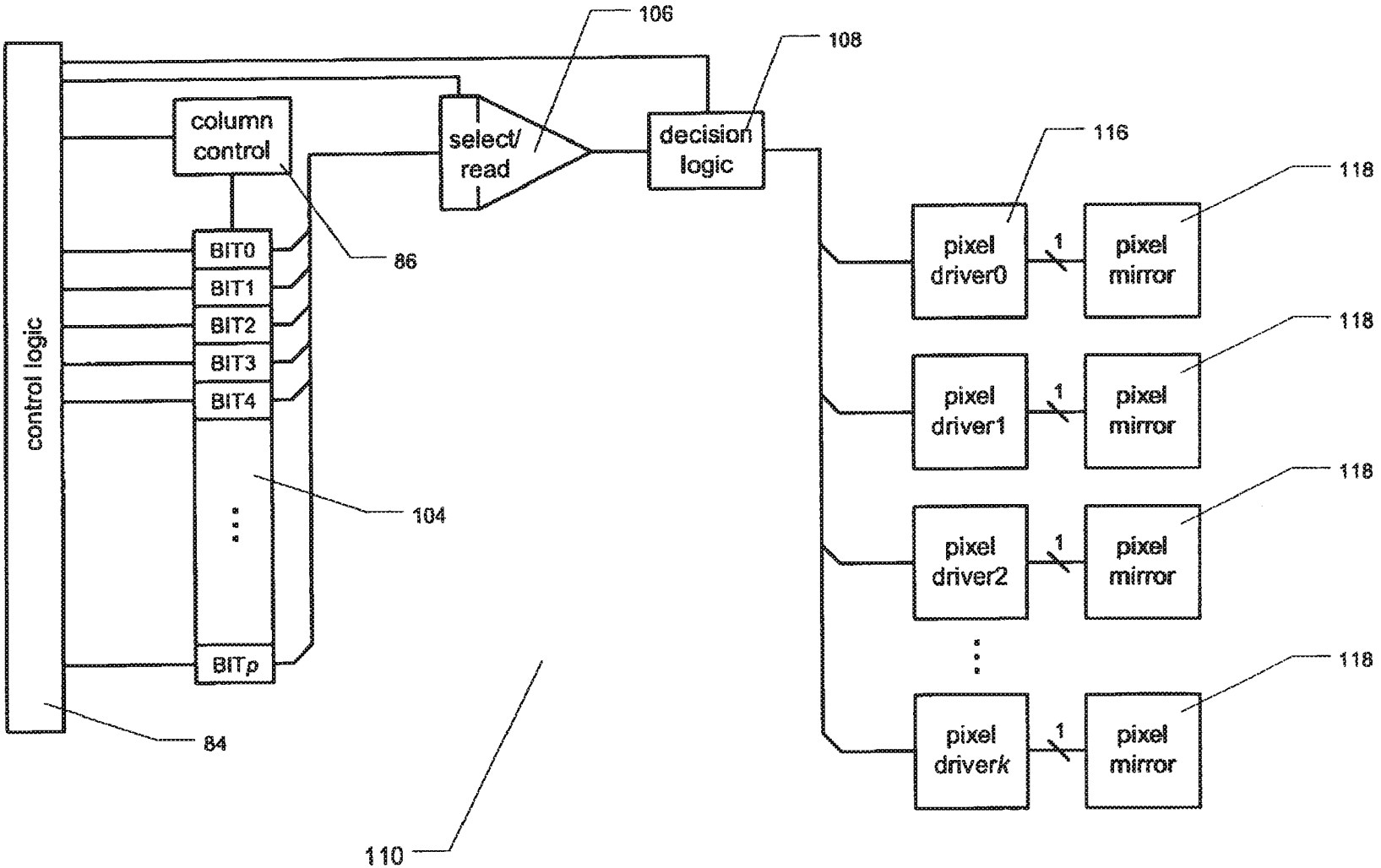
FIG. 15 is a block diagram of control logic for displaying grayscale in a pixel array.

FIG. 15 shows the digital control logic 110 associated with a group of k pixels in the pixel array 80. Each pixel in the group has a pixel electrode 118, which in the case of reflective display may also be a pixel mirror. Each pixel electrode is driven by a pixel drive circuit 116, also occasionally denoted as a boost circuit. For many of the different types of display devices, two-level electrical pixel drive by a suitable digital waveform can provide gray scale display. Either the pixel's optical effect itself may be binary, with rapid switching between optical ON and OFF states in response to the two applied electrical drive levels (the pixel emitting, transmitting, or reflecting light in the ON state, and not emitting or blocking light in the OFF state) producing the various gray shades by time-averaging within the eye of the human (or machine) viewer, or the pixel may have an analog optical response to a time average of the electrical drive level. Examples of the first type of pixel optical effect in include the fast ON/OFF switching of ferroelectric liquid crystals (FLCs), the fast ON/OFF switching of the tilting pixel mirrors employed in the Texas Instruments Digital Micromirror (DMD) or Digital Light Processing (DLP) devices, the fast and the fast ON/OFF switching of plasma emission in a plasma display, and the fast ON/OFF switching of light-emitting diodes (whether organic or inorganic). Examples of the second type of pixel optical effect include slower responding nematic liquid crystals. Signals qualifying as "two-level electrical pixel drive" signals are not here meant to be restricted to signals that take on only two distinct levels over the lifetime of the display, but rather a class of signals that, taking on two different levels during some interval of time, can drive a pixel to many different shades of gray during that interval of time. For example, a signal that switched between 0 and $V_1$ when the display was at temperature $T_1$, and, to compensate for temperature dependence of the pixel optical effect changed to switch between 0 and $V_2$ when the display was at temperature $T_2$ would still fall within the meaning of two-level pixel drive signal. Further a pixel drive signal that, to compensate for the wavelength dependence of a pixel optical effect, switched between 0 and a voltage $V_R$ during a red color field when the pixel was illuminated with red light, and switched between 0 and a different voltage $V_G$ during an immediately following green color field when the pixel was illuminated with green light would also still fall with the meaning of two-level drive signal. For some other types of display devices, analog (rather than two-level) drive levels on the actual pixel drive electrode can still be achieved by digital pixels wherein digital pixel circuitry controlled, for example through variations in timing, the electrical drive level resulting on the pixel electrode. The charge-control drive scheme described below exemplifies this technique. Such devices still fall within the meaning of "digital pixel" and "digital display."

Each pixel in the group shares a common decision logic circuit 108 and a select/read circuit 106. Digital image data utilized by the pixel group is stored in a set 104 of image data registers. The image data stored in the registers, which data may represent gray-scale images and/or multi-color or full-color images, may be provided from an external image data source by way of digital control logic 84 and a column control unit 86. If each of the k pixels in the group displays, for example, an m-bit gray-scale image in each of three colors (to make a full-color field-sequential display), and the image data registers provide double-buffered storage, then a total of $p=2\cdot3\cdot m\cdot k$ single-bit registers are required for the group (unless the image data is stored in compressed form or is shared between pixels, in which case fewer registers may be needed). If the display active area is made up of an N×M array of pixels then there will be NM/k pixel groups. The number k of pixels per group could range from 1 (each pixel having its own image data registers, its own select/read circuit, and its own decision logic circuitry) up to M (each column of pixels sharing a set of image data registers and a select/read circuit and a decision logic circuit), or to an even larger number.

The image data registers may be implemented in any of the various ways known in the electronic memory art. For example, they may be implemented as conventional six-transistor (6T) static random-access memory (SRAM) cells, or as other forms of static logic such as any of the many other static latch circuits, shift-register stages, and so on. Alternately, the image data registers may be implemented as one-transistor (1T) dynamic random-access memory (DRAM) cells or by storing the image data as charge on a FET transistor gate, such as at the input of some other logic gate. The image data memory registers are written with data that represents an image. The input image may be supplied from a source external to the display, such as broadcast video or the output of a video player such as a (DVD player, or from a computer graphics output, or from an image-sensor or camera system, or similar. Various transformations to the input image data may be applied before it is stored in the image data memory registers. Such transformations include compression, resealing, clipping or over-scanning, color-space transformations, various coding schemes, and the like. The control unit 84 cooperates with the column control unit 86 to ensure that input image data corresponding to a certain display pixel is written into the appropriate registers, i.e. those registers that are associated, either logically or physically, with that pixel. After the image data are written into the various registers, they are held there until they are needed, at which time the needed register is selected and read out by the select/read circuit 106. For many of the various types of possible image data register implementations, the read operation will sense some relatively small stored value and convert it to full logic levels. For example, in the case of DRAM registers, the image data are represented as small charges stored on register capacitors. In this case, a sense amplifier in the select/read circuit 106 may be used to convert stored charge values above a threshold value to a logic 1 and stored charge values below the threshold value to a logic 0. Alternately, in the case of SRAM registers, where there is capacitance loading the register outputs, arising for example from shared interconnections used to multiplex multiple registers within a group of pixels onto the to the shared select/read circuitry, a sense amplifier or detection circuit within the select/read unit 106 may act to precharge the capacitance loading the register output, and to then detect relatively small changes in the voltage developed across this load, thereby speeding up the read operation.

The decision logic unit 108 acts on the image data read out by the select/read unit 106 to produce signals that control the drive waveform provided by the pixel driver 116 to the pixel electrode 118, in order to produce the desired or called-for gray-scale response. Sophisticated, many-transistor implementations of select/read unit 106 enable more sensitive Detection of the state of the registers in the image data memory 104, and hence enable the use of simpler, more compact register forms. Similarly, more sophisticated functionality implemented at the cost of increased transistor count in decision logic unit 108 enables higher-performing digital gray scale pixel-drive waveforms such as pulse-width modulation where the output gray-scale intensity is determined by the width of a single pulse. To accommodate the increased layout space associated with increased sophistication and corresponding greater transistor count of units 108 and 106 while preserving an overall high display pixel density, the select/read unit 106 and decision logic unit 108 may be made to serve a greater number k of pixel within a group of pixels. While such a design strategy may appear to provide desired pixel density and drive waveform sophistication, it demands increasing clock rate as k is increased, and produces power dissipation that increases faster than k. The novel embodiments of the present invention, however, as illustrated by the following examples, show how the apparently contradictory requirements of compact image data registers, sophisticated pixel-drive waveform generation, and low-power, low-speed small k can simultaneously be met.

Figure 6:
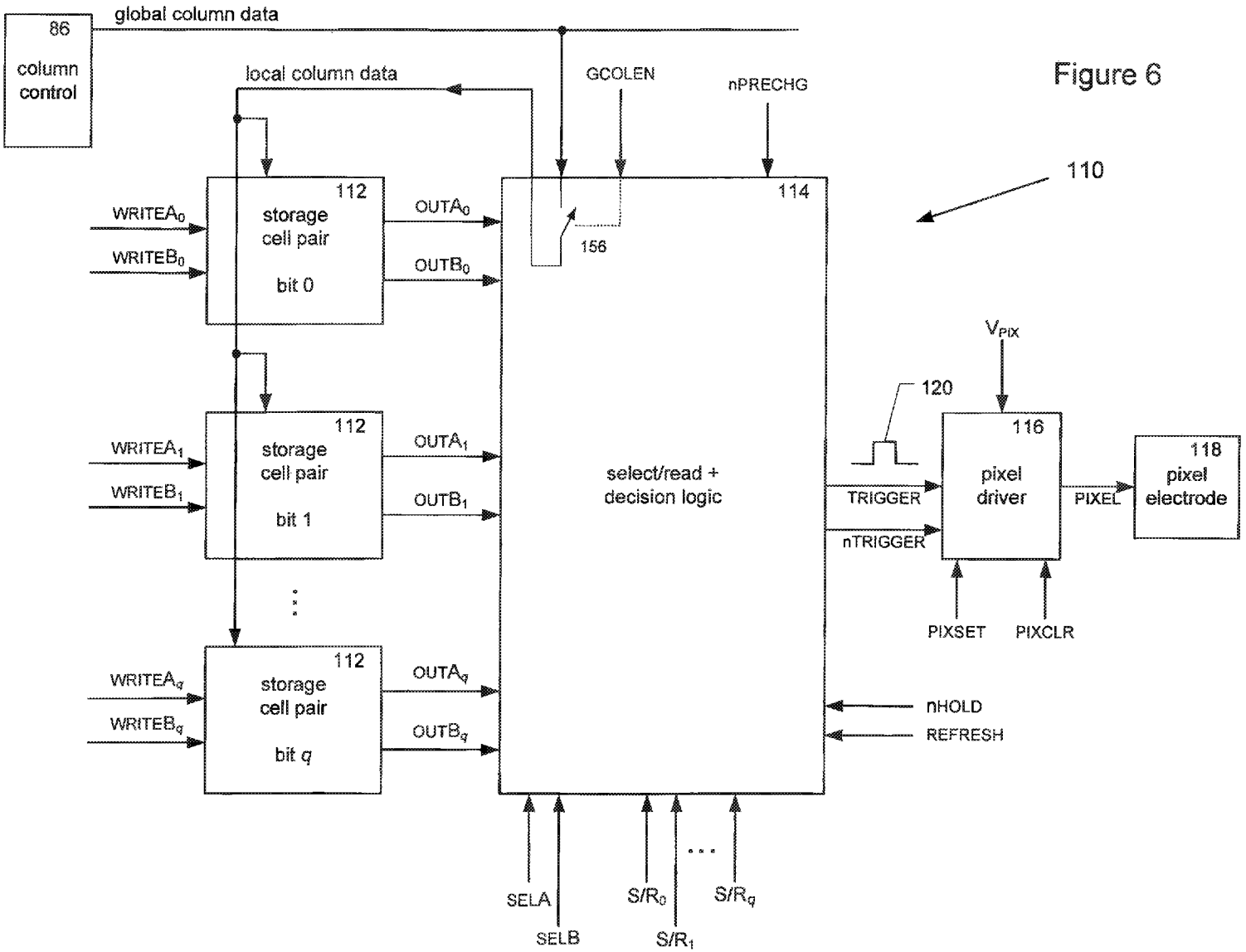
FIG. 6 is a block diagram of portions of the control logic shown in FIG. 5.

FIG. 6 shows the digital control logic 110 associated with each pixel in the pixel array 80, according to a first embodiment of the invention in which the number k of pixels per group is one. As can be seen, each pixel has q storage-cell pairs 112 that are each connected to a select/read and decision logic unit 114 that generates a trigger signal 120 provided to a pixel driver 116, which in turn provides a drive waveform that is applied to a pixel electrode 118. Although not each one is shown, there is a storage cell pair 112 for bit 0, a storage cell pair 112 for bit 1, a storage cell pair 112 for bit 2, and so on, up to a storage cell pair 112 for bit q. Each storage cell pair 112 receives image or column data from the column control unit 86 that is distributed to each pixel along a "global" column that serves multiple pixels, and routed onto individual storage cells via a terminal local to the pixel called the "local" column, under the control of logic unit 114. Each storage cell pair 112 also receives commands WRITEA and WRITEB from the row control unit 88 that enable selectively writing to the first or second register in each pair respectively.

Each storage cell pair 112 generates an OUTA and OUTB signal that are provided to the decision logic unit 114. The decision logic unit 114 also receives a precharge signal from the control unit 84. The decision logic unit 114 receives the OUTA and OUTB signals from each of the storage cell pairs 112 along with a SELA signal and a SELB signal, and it receives select/read (S/R) commands from the row control unit 88. It generates a trigger signal 120 that is provided to the pixel driver 116. In addition to the trigger signal 120, the pixel driver 116 receives a PIXSET signal, a PIXCLR signal, and a pixel power supply voltage $V_{PIX}$ (which is typically different from and has a higher voltage than the logic supply voltage used by the digital control logic 110—for example, the digital control logic might be powered by a 1.8-V supply while the pixels were driven to 5 V or to 7 V) The pixel driver 116 generates a pixel drive waveform that is applied to the pixel electrode 118.

Figure 7:
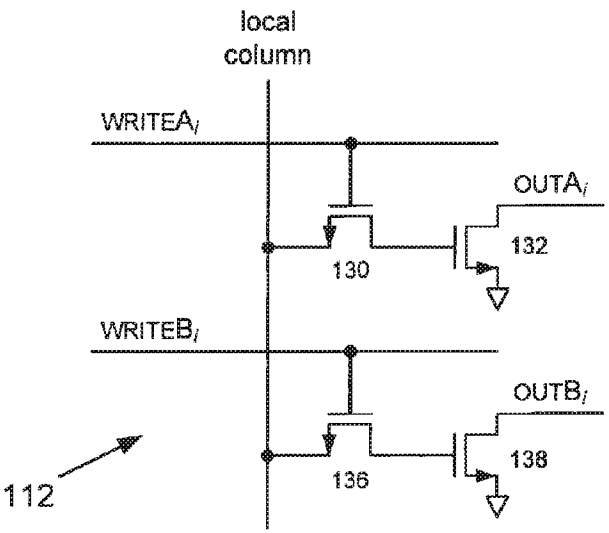
FIG. 7 is a generalized schematic of a storage cell pair of FIG. 6.

FIG. 7 shows further detail of the $i^{th}$ one of the storage cell pairs 112. FET switches 130 and 132 are the portion of the storage cell pair 112 in which the A data is stored, while FET switches 136 and 138 are the portion of the storage cell pair 112 in which the B data is stored. Looking first at the portion of the storage cell pair 112 in which the A data is stored, it can be seen that local column data is provided to the source terminal of the n-channel FET switch 130. The WRITE$A_i$ signal is provided to the gate terminal of the FET switch 130. As can be appreciated, when the WRITE$A_i$ signal is in a high state, the switch 130 is turned on and the local column data is provided to the gate terminal of the FET switch 132. Even after the WRITE$A_i$ signal returns to a low state, the local column data remains stored as charge on the gate terminal of the FET switch 132. This is essentially the "memory register" in which one bit of data is stored in each half of storage cell pair 112.

If the data bit stored at the gate terminal of the FET switch 132 is a zero (low state), then the FET switch 132 is turned off. If the data stored at the gate terminal of FET switch 132 is a one (high state), then the FET switch 132 is turned on and the OUT$A_i$ signal (the source terminal of the FET switch 134) is pulled to a low state.

The FET switches 136 and 138 operate in a similar fashion to store B image data therein and control the state of the OUT$B_i$ signal from the storage cell pair 112. A separate WRITE$B_i$ signal is provided to the gate terminal of the FET switch 136. The local column data is provided to the source terminal of each of the FET switches 130 and 136. Typically, local column data is only written at a given time to one of the two memory registers, as only one of the WRITE$A_i$ or WRITE$B_i$ signals will be high at a given time. It is possible, however, in some applications, if desired, for data to be simultaneously written to both memory registers by having both the WRITE$A_i$ and WRITE$B_i$ signals be high at the same time. Further, it is not necessary that storage cell pair 112 share a column line; each could be provided with a dedicated line.

Figure 8:
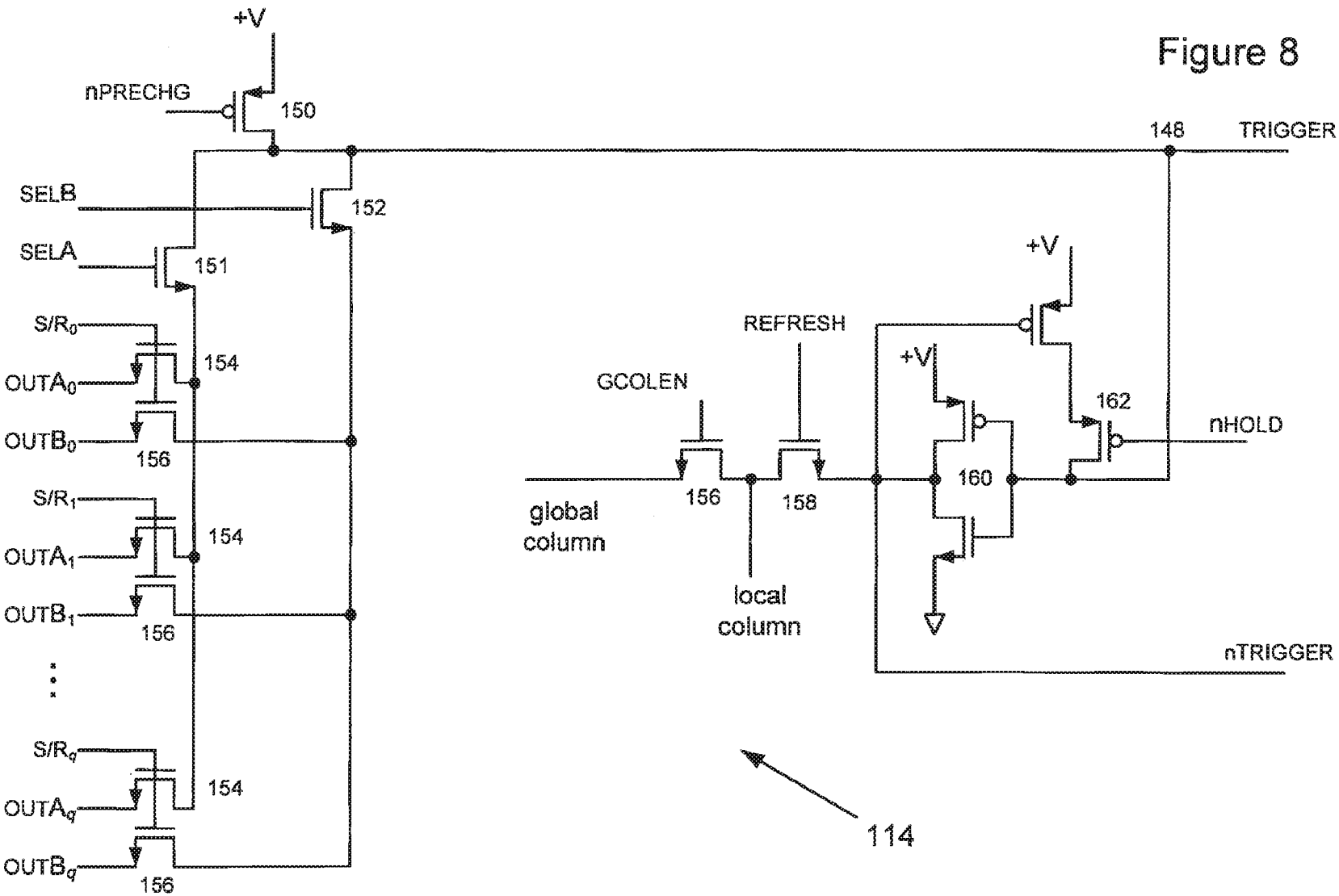
FIG. 8 is a generalized schematic of portions of the select/read and decision logic of FIG. 6.

FIG. 8 provides further detail on the decision logic unit 114. A p-channel FET switch 150 is used to precharge a central node 148 of the decision logic unit 114 when a signal ("not precharge"—NPRECHG) is provided to the gate of the FET switch 150. The q output signals OUT$A_0$ through OUT$A_0$ from the A sides of the q corresponding storage cell pairs 112 are connected together to the source of a second FET 151, while the q output signals, OUT$B_0$ through OUT$B_q$ from the B sides of the q corresponding storage cell pairs 112 are connected together to the source of a third FET 152. With neither the A nor B data selected (SELA and SELB both low), pulsing the NPRECHG signal low momentarily closes FET switch 150 to provide the logic supply voltage (V) to the central node 148, pulling it to a high state. When the A field of data is selected, the SELA signal goes high, FET 151 is turned on, and a selected subset of the q OUT$A_i$ signals, those selected by having their SIR lines pulled high, are connected together to central node 148 through FET switches 154 and 151. If any of the selected OUT$A_0$ through OUT$A_q$ signals are pulling low then the central node 148 will be pulled to a low condition as well, but otherwise it will be left high. The states of the OUT$A_i$ signals not selected (those whose S/R lines are low) are ignored. Similarly, when the B field of data is selected, the SELB signal, goes high (with SELA low), FET 152 is turned on, and a selected subset of the q OUT$B_i$ signals, those selected by having their S/R lines pulled high, are connected together to central node 148 through FET switches 156. Again, if any of the selected OUT$B_0$ through OUT$B_q$ signals are pulling low then the central node 148 will be pulled to a low condition as well. After the precharge cycle, with one of the A or B inputs still selected, the signal NHOLD ("not hold") goes active low, providing positive feedback around inverter 160. If node 148 is not actively being pulled low by at least one of the selected OUT lines, then this feedback will force node 148 actively high. Thus, this step resolves the state of the TRIGGER signal 120 at node 148 to a full high or low logic level.

In this way the states of multiple selected registers can be read out in parallel and contribute simultaneously to the decision reached by the decision logic unit. In the embodiment described with reference to FIG. 8, the decision logic unit implements a wired NOR functions: if any of the selected registers store a one then the output is low. How this can be used to generate pixel drive waveforms such as pulse-width modulation (PWM) waveforms will be explained in more detail below.

Figure 9:
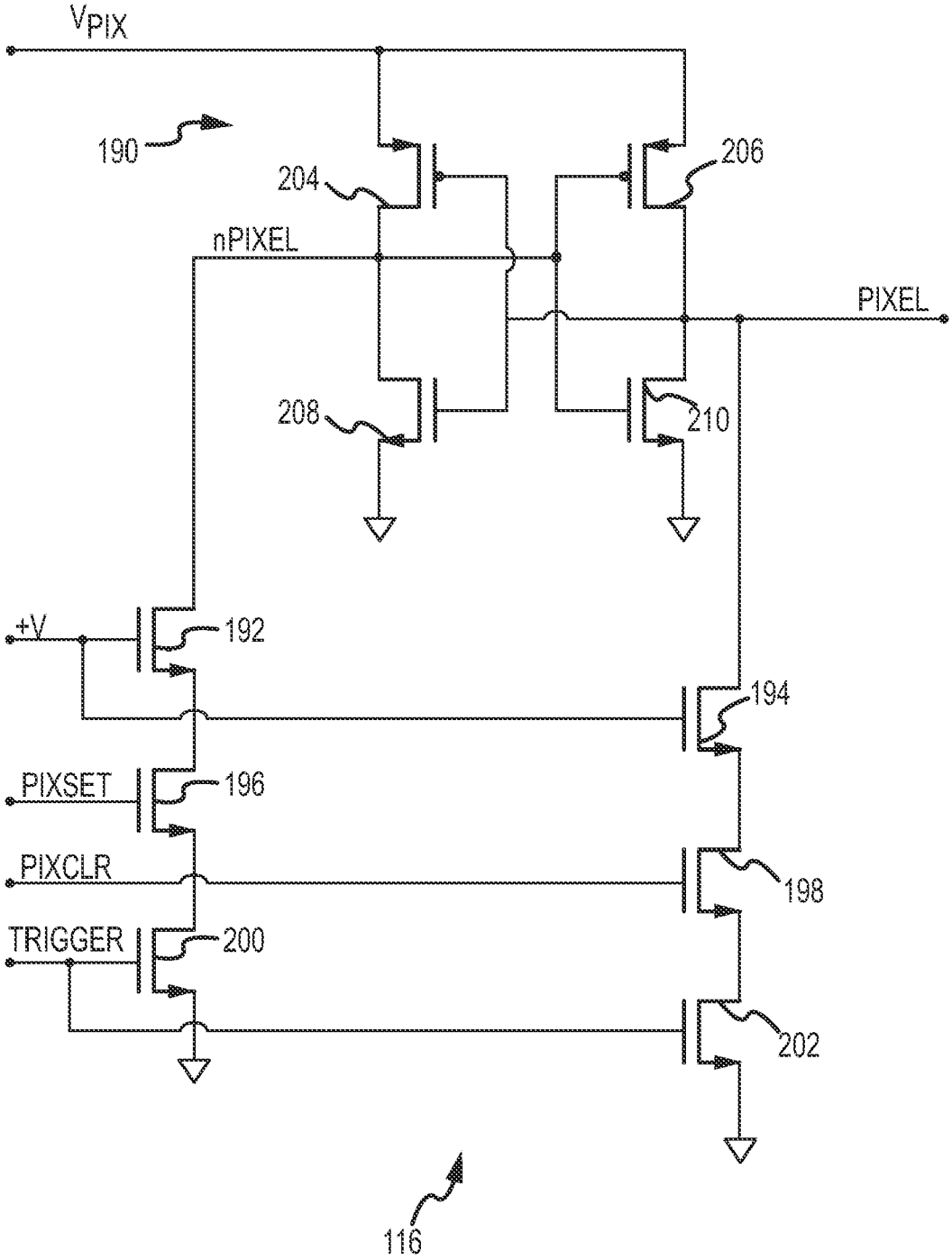
FIG. 9 is a generalized schematic of portions of a pixel driver of FIG. 6.

The pixel driver 116 illustrated in FIG. 9 includes a latch circuit 190 ad six FET switches 192, 194, 196, 198, 200, and 202. These six switches control the state of the latch circuit 190, mid thus the state of the pixel electrode 118. The latch circuit 190 includes four FET switches 204, 206, 208, and 210, which may designed to operate with a supply voltage $V_{PIX}$ different from (usually higher than) the supply voltage used by most of the rest of the logic circuitry. Two of these four switches 204 and 206 are p-channel FET switches while the other two switches 208 and 210 are n-channel FET switches. The four switches 204, 206, 208, and 210 form two inverters which have their outputs and inputs cross-coupled in the usual way to make a static latch. The latch output node between the two switches 206 ad 210 provides the PIXEL signal which drives pixel electrode 118. FET switches 194, 198, and 202 are connected together in series between the PIXEL, signal and ground, while FET switches 192, 196, and 200 are connected together in series between the latch's other side (NPIXEL) and ground. Switches 192 and 194, with their gates biased by the voltage supply signal (+V) serve to prevent the damage to switches 196, 198, 200, and 202 that might otherwise occur if the full voltage supplied by $V_{PIX}$ were to appear across them (as it would in the absence of 192 or 194). Switches 196 ad 198 are controlled by the PIXSET and PIXCLR signals, respectively, which signals are provided by the control unit 84. The TRIGGER signal from the decision logic unit 114 is provided to the gate of both of switches 200 and 202. If PIXSET is high (PIXCLR low), a high, TRIGGER Signal will cause FETs 192, 196, and 200 to pull the NPIXEL node low, latching the PIXEL node high. Alternatively, if PIXCLR is high (PIXSET low), a high TRIGGER signal will cause FETs 194, 198, and 202 to pull the PIXEL node itself low, latching it in that state. In this manner, the digital control logic 110 controls the state of each pixel electrode 118.

Figure 16:
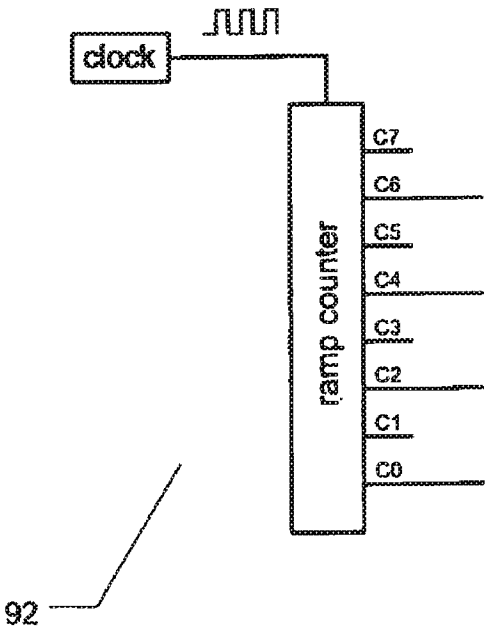
FIG. 16 is a block diagram of logic for generating a first digital ramp.

The circuitry described above with reference to FIGS. 6, 7, 8, and 9 can be used to generate a variety of pixel drive waveforms. According to a first control method, it can be used to generate PWM drive waveforms. This can be achieved by applying appropriate signals to the select/read lines associated with the image data registers in each pixel. Consider, only for example, that it is desired for the display system to accept conventional 24-bit color video signals (one 8-bit gray-scale value for each pixel for each of the red, green, and blue primary colors), and convert this input signal to sequential color with PWM digital gray scale drive to each pixel. Further consider in this example that it is desired to double-buffer the image data to avoid the tearing artifact. This can be accomplished by providing each pixel with 24 register pairs (24 registers in bank A and 24 in B), resulting in each pixel having 24 select/read lines, $S/R_0$ through $S/R_{23}$. In the nomenclature used previously, this example is characterized by having m=8, p=48, and q=24. Suppose further, for purposes of nomenclature alone, that the registers pairs storing input image data to be displayed in red are numbered 0-7, data to be displayed in green are stored in register pairs numbered 8-15, and data to be displayed in blue are stored in register pairs numbered 16-23, with the least significant gray-scale bits in the lowest register number (0, 8, 16) and the most significant gray scale bits in the highest register number (7, 15, 23). A first frame of input image data is stored in the A bank by passing input data through control logic unit 84 to column control unit 86, then onto pixel array "global columns," and by activating signal GCOLEN ("global column enable") onto each pixel's "local column." By activating the WRITEA signals, the input data can be written from each pixel's local column into its A-side registers, as described above with reference to FIG. 7. After writing this first frame of data into the A registers, and while a second frame is similarly being written in the 13 registers, the A-side registers can be read out as follows. Sequence generator 92 in this case is an eight-bit counter, as illustrated in FIG. 16, which is driven for example by a clock signal to provide a sequence of monotonically decreasing 8-bit values. If it is desired to first display the data representing the red image information, the eight bits C0-C7 of this sequence are first applied to the $S/R_0$ through $S/R_7$ lines of all the pixels in the display (while the other 16 S/R lines in each pixel are all held low). That is, the least significant bit C0 of the counter output is distributed to each pixel's $S/R_0$ line, and so on. The precharge and SELA signals of FIG. 8 are pulsed once for each sequence state. At any given sequence state, the image data in registers associated with a low sequence-generator output line (that is, image data in registers whose s/R line is low or deselected) are ignored. Thus, during the phase while red information is being displayed, all the registers holding information to be displayed in green or blue are ignored. Depending on the sequence state even some of the information to be displayed in red is ignored. Among the registers within a pixel associated with a high sequence generator output line (that is, registers where the counter state has caused the S/R line to be driven high), if any stores a one, then node 148 will be pulled low and the trigger signal 120 will be inactive. On the other hand, if, at a given sequence state, all the registers in a given pixel associated with high sequence generator output lines store zeroes, then the precharge/SELA cycle will leave that pixel's node 148 high, and, upon activation of NHOLD, that pixel's TRIGGER line will be pulled high. Upon activation of a chosen one of PIXSET or PIXCLR, the high TRIGGER line will result in the setting of pixel latch 190 to a particular state.

That this can produce a PWM drive signal is seen by considering the simplified version of such an algorithm tabulated in FIG. 10 where, for simplicity of exposition, instead of eight bits only four bits are shown. As can be seen, the sequence generator output provides a digital ramp signal, monotonically decrementing in value, with output bits C0 through C3. The next four columns in the FIG. 11 table (labeled "stored image data bit") depict which of the four bits of data stored in the pixel registers 112 are examined. In the locations designated as E the given bit will be examined, while in the locations designated as X the given bit will not be examined. Referring briefly to FIG. 8, when a given bit is to be examined, the select/read signal will be high so that switches 154 and 156 are turned on. When a given bit is to be ignored, the select/read signal is in a low condition and switches 154 and 156 are not turned on. The rightmost column of the table in FIG. 10 lists the four-bit pixel values that would produce a high value of the TRIGGER signal. As can be seen, at time-step 1 in the initial 1111 sequence generator state when all of the four bits are examined, the only stored pixel data value that will produce a high TRIGGER is 0000. On the next sequence state 1110 at time step 2, only registers 1, 2, and 3 are examined, and high TRIGGER lines will result either if the stored image data value has the value 0001 matching the inverse of the counter value or if it has the non-matching value 0000. On the third time step when the sequence generator outputs 1101, only registers 0, 2, and 3 are examined, and high TRIGGER outputs will result either if the stored image data value has the value 0010 matching the inverse of the counter value or if it has the non-matching value 0000. As can be seen from FIG. 10, for the second and third time steps the stored image data value 0000 produces a high TRIGGER condition as does one stored image data value that matches the inverse of the counter value. Of course, given that the counter is decrementing monotonically downward from an initial 1111 state, the stored data value 0000 already produced a high TRIGGER at the first counter state, so it does not matter for the purposes of producing a PWM waveform that it does so again later, since the sequence has already passed this point by the time this combination of bits are examined, and additional high TRIGGER signals will produce no further changes in the state of pixel driver 116, as will be explained later. At the fourth time step, with sequence generator output state 1100, only registers 2 and 3 are examined and high TRIGGER signals are produced for stored image data values 0000, 0001, 0010, and 0011. As can be seen, the combination of bits that are ignored is stepped through in a ramp-like fashion itself. It can also be seen that whenever the sequence output is such that one bit is ignored there will be two stored image data values that produce high TRIGGER signals, whenever two bits are ignored there will be four stored image data values that produce high TRIGGER signals, whenever three bits are ignored there will be eight stored image data values that produce high TRIGGER signals, and in the one case where all four bits are ignored, there will be 16 stored image data values that produce high TRIGGER signals (that is, any possible stored image value would produce a trigger). In each of these cases, however, the triggering data value that is listed last in the appropriate table cell of FIG. 10 is the key value, since each of the other listed values has previously produced a trigger. The system as described herein works because in the described pulse width modulation (PWM) method or algorithm, each of the pixels starts a given video field interval in the ON condition and is turned OFF as soon as the first high TRIGGER state occurs. Even if additional high TRIGGER states occur after the first one, the pixel drive circuitry of FIG. 9 acts so that pixel will still stay in the OFF condition. Thus, additional trigger events after the first one are of no consequence. The same is true if the PWM system starts each pixel in the OFF condition and turns it ON when the first high TRIGGER state occurs (which is effected by storing the inverse of the input image data in the pixel registers, the input image data having been selectably inverted by control logic 84, and utilizing the PIXSET signal instead of the PIXCLR signal).

It is known in the liquid crystal art that liquid crystal pixels perform best when driven with drive waveforms that have an average voltage of zero, that is, when driven with waveforms that are "DC balanced". DC-balanced PWM drive waveforms can be provided by the circuitry described above. Consider, for example, a drive scheme that begins a video field with all the driven to their ON state, effected with the pixel drive of FIG. 9 by momentarily pulsing all pixel's PIXSET lines high (while all the TRIGGER lines are also high, achieved, for example, by momentarily activating nPRECHG while SELA and SELB are low and then activating nHOLD). Then applying the decreasing-counter sequence to the S/R lines, with trigger events being used to change the state of the pixel driver by pulsing the driver's PIXCLR line, results in the application of a digital PWM waveform to the pixels, as described above. To produce a DC-balanced waveform, the above cycle can be repeated, with the same sequence applied again (that is, again accessing the same image data values by activating the same set of S/R lines), but with the pixel beginning the cycle in their OFF state, effected by momentarily pulsing all the pixel's PIXCLR lines (with all the TRIGGER lines again high), and then changing the pixel driver's state upon a trigger event by pulsing the PIXSET line. In the case of polarity-sensitive pixel optical means, such as ferroelectric liquid crystals, where ON and OFF also indicate the optical state of the pixel, the display illumination is blanked during the second cycle. In the case of pixels with rms-responding pixels, illumination can be provided throughout both cycles.

The above descriptions portray driving the entire array of pixels synchronously with the same global sequence. This is not necessary. Different sequences could be distributed to different rows in the display. It is known in the projection art to illuminate a microdisplay with "scrolling" illumination where bands of red, green, and blue illumination are moved across the panel in sequence, in a way that the panel may at a given instant be illuminated over one portion with a band of light of one color and over a different portion with a band of light of a different color. By providing each row with its own sequence, delayed slightly in time from the same sequence supplied to the previous row, the display pixels can produce a time-sequential gray-scale pattern appropriate for producing color-sequential display with such illumination.

The decision logic unit 114 of the above embodiment offers considerable advantages over prior comparator-based circuits for providing pulse-width modulation. A circuit to compare one digital word (the stored image data) with another (the sequence code), for example a multi-input XOR circuit, requires inputs of both the data value and its complement and the code value and its complement, or four inputs per bit. This results in a decision circuit with an undesirably high transistor count and that produces a pixel that is undesirably large. On the other hand, the PWM scheme employed by the above embodiment of the present invention does not compare the two signals. The fact that the NOR circuit (which is has far fewer transistors than, for example, an XOR-based comparator) would, if considered to be a comparator, produce erroneous matches as described with reference to FIG. 10 is not of consequence given that the sequence generator 92 produces a pre-determined sequence wherein these "erroneous" matches occur later in time than does the state that determines the timing of the pulse trailing edge.

Figure 11:
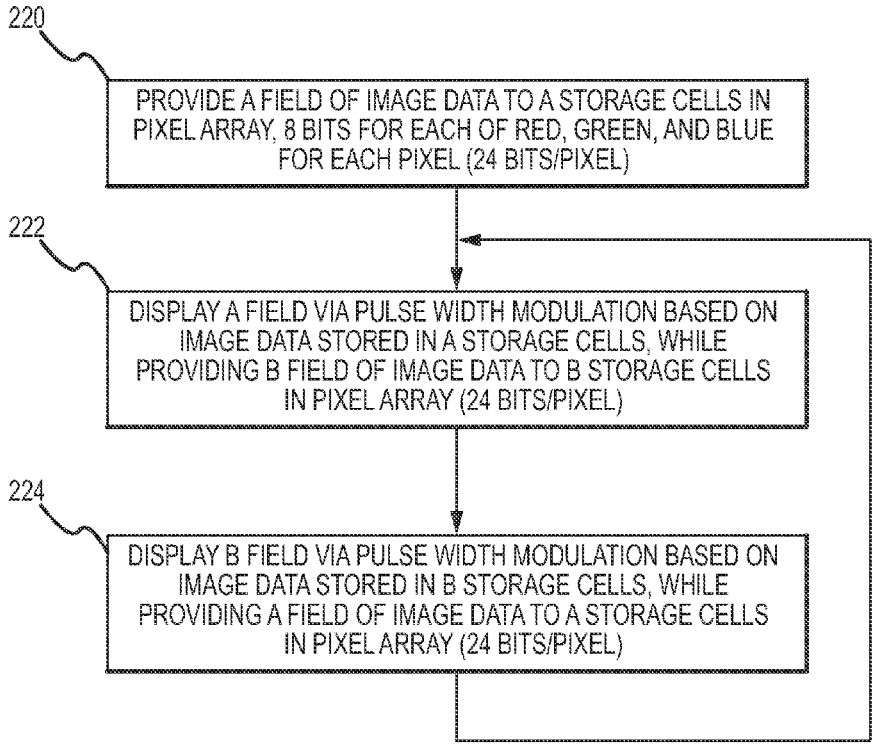
FIG. 11 is a flowchart showing the process of alternately storing one field of data while displaying another field of data.

According to the above description, it can be seen that the LCOS display panel 64 displays data in the fashion shown in FIG. 11. As shown in process step 220, the A field of image data is provided to the A storage cells in the pixel array (in this example, eight bits for each of red, green, and blue for each pixel, or a total of 24 bits per pixel). Next, as shown in process step 222, the A field is displayed via PWM, based on the A image data stored in the A storage cells, while the B field of image data is provided to the B storage cells in the pixel array (in this example again 24 bits per pixel). Next, as shown in process step 224, the B field is displayed via PWM, based on the B image data stored in the B storage cells, while the A field of image data is provided to the A storage cells in the pixel array (24 bits per pixel). After process step 224, process step 222 is again performed (with new A data) followed by process step 224 (with new B data) and these two steps are repeated sequentially while image data is being displayed.

Figure 12:
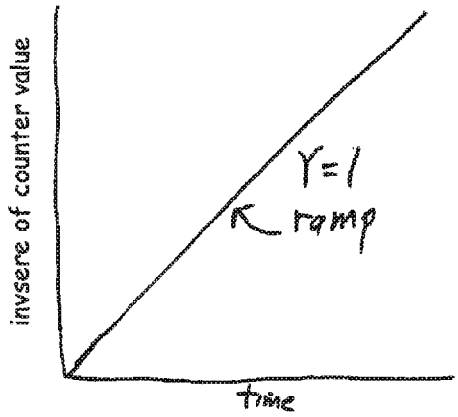
FIG. 12 is a simplified drawing of a ramp signal.
Figure 14:
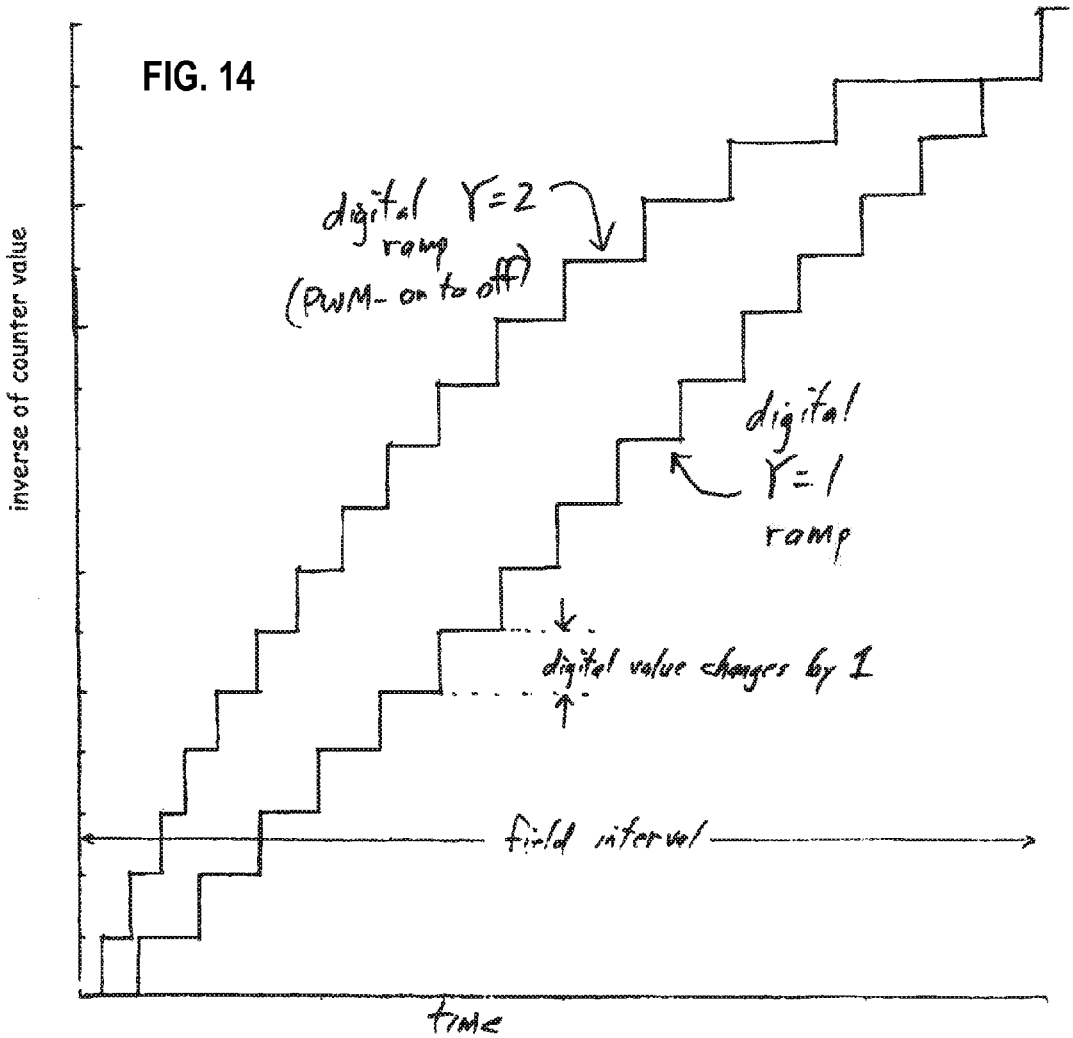
FIG. 14 shows digital ramps with different gamma characteristics.
Figure 13:
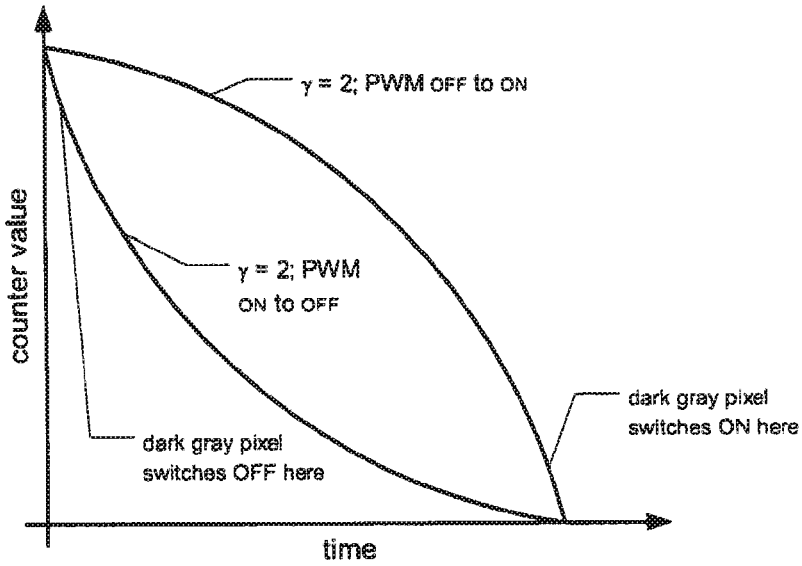
FIG. 13 is a simplified drawing of two different ramp signals with different gamma characteristics than that shown in FIG. 12.
Figure 17:
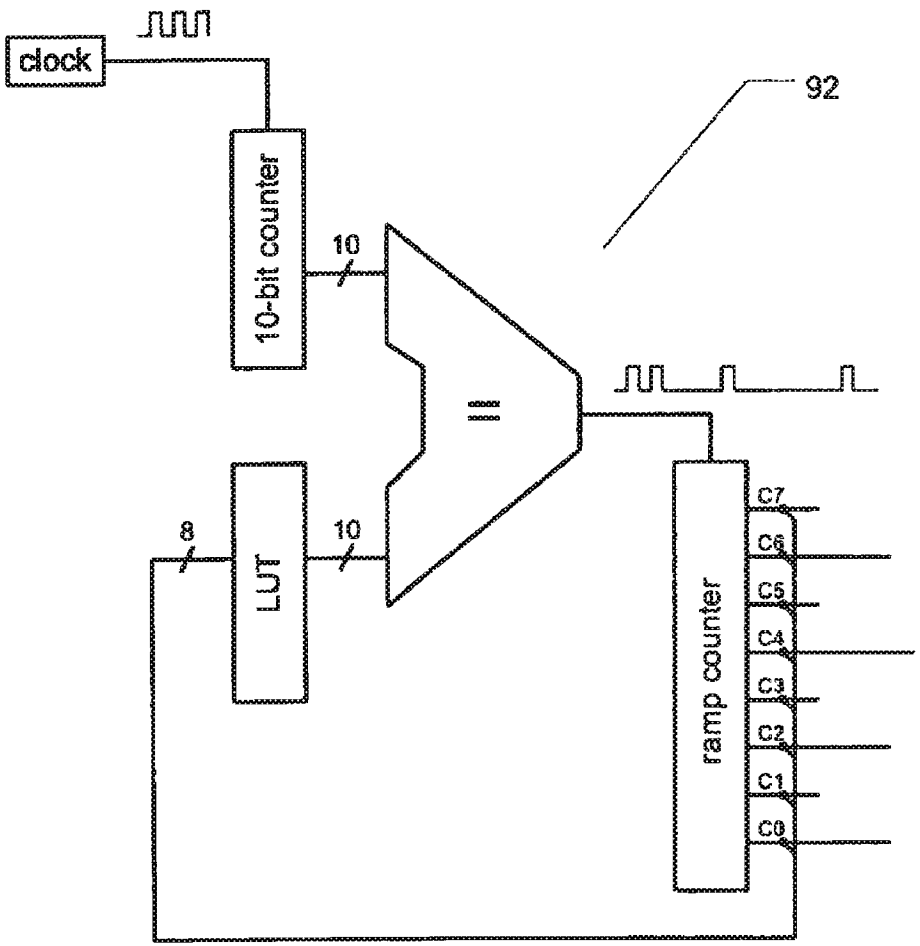
FIG. 17 is a block diagram of logic for generating a digital ramp having a gamma characteristic determined by the value of a lookup table.

In order to change the gamma characteristic of the display systems described herein, it is possible to vary the timing of the sequence signal. FIG. 12 shows the simple ramp sequence signal (simplified in part to not show the digital nature of the ramp) that is generated by the sequence generator 92 depicted in FIG. 16 as a clock and counter, plotted as the inverse of the sequence state versus time. With a periodic clock signal driving the counter the sequence is a digital ramp decreasing linearly with time. Using the PWM drive method described above, the pixel drive waveform divides each temporal display field interval into two portions, an ON portion and an OFF portion. With a linear ramp sequence, the width of the ON pixel drive portion also increases linearly with stored image data value. In the case of a fast-responding, binary ON/OFF pixels, like modulators made from ferroelectric liquid crystals or from tilting micromirrors (or other MEMS modulators) or emitters made from plasma or organic or inorganic LEDs or lasers, this drive characteristic gives a display with a gamma characteristic of one. FIG. 13 shows a sequence signal that would provide a displayed image with a gamma characteristic of approximately two, plotted as sequence state vs. time. In the case of gamma greater than one, the intervals between adjacent gray shades at the low-intensity end of the gray scale are relatively short compared to the intervals between shades at the high-intensity end. FIG. 14 shows a pair of digital ramp sequences. In one of the digital ramps the counter value decreases linearly with time ($\gamma=1$), while the other it decreases at a faster rate early in the ramp and at a relatively slower rate at a later position in the ramp ($\gamma=2$); the intervals between sequence-state changes are small in the early part of the ramp, as would be appropriate for the case where the pixels start out ON and are later turned OFF. To display m bits of gray scale with a characteristic of $\gamma=1$ during a video field of duration T, the sequence state starts at $2^m-1$ and decreases to 0 in even steps each having a duration $t=T/(2^m-1)$. For the same gray depth, but a characteristic of $\gamma=2$, the intervals between sequence states should have a duration $t=T(2i-1)/(2^m-1)^2$, where i enumerates the $2^m-1$ intervals. That is, for an eight-bit gray scale (m=8) the sequence should start with the value 1111111, should decrement to 11111110 after a time T/65025, should decrement again to 11111101 after an additional time 3T/65025, should increment again to 111111100 after an additional time 5T/65025, and so on, finally decrementing from 00000001 to 00000000 after an interval of 509T/65025. Thus, the initial decrements are of shorter duration while the later decrements are of longer duration. In this way, the change in brightness of a display pixel when stepped between adjacent gray shades of a low gray value is smaller than the change when stepped between adjacent shades at high gray values. It should be noted that gamma characteristics of 1 and 2 have been discussed herein; it may be desirable to implement a gamma characteristic of a different value (e.g., 0.45, or 2.1 or 2.2 or even 3), or even to implement gray-scale input-output transfer curves that are not power-law curves, and hence cannot be simply characterized by a single gamma parameter. For example, when a digital pixel as described herein employs an analog-responding nematic liquid crystal modulator, the optical response to varying two-state drive duty cycle exhibits a nonlinear characteristic which can be compensated by a drive signal having an inverse nonlinearly provided by appropriate timing of the sequence states. FIG. 16 shows one of the many possible ways to realize a sequence generator with constant time intervals, which are needed to produce a gamma characteristic of one. FIG. 17 shows one of the many possible ways to realize a sequence generator with varying intervals needed to produce gamma characteristics different from one, that is, where the intervals between the times throughout a field when a pixel can change state are not constant, or to produce other nonlinear drive characteristics. Here an ordinary periodic clock drives a 10-bit counter, whose output is one of the inputs to a 10-bit digital equality comparator. The other comparator input is provided from a look-up table (LUT) having 10-bit data outputs determined from an 8-bit input address, corresponding to a choice of 8-bit gray depth in this example. The output from the equality detector clocks the 8-bit ramp counter that also provides the address input to the look-up table. The 255 entries in the look-up table specify the value of the 10-bit count at which their 8-bit address should be supplied as the sequence generator output. Thus, the 255 8-bit output values can be placed at various positions within a time interval with 10-bit precision. If greater precision is desired it is straightforward to increase the size of 10-bit counter, the 10-bit length of the look-up table entries, and the input width of the equality comparator to a greater number of bits. Loading different sets of 10-bit data words in the look-up table provides the means to programmably change the display gamma characteristic. By expanding the look-up table, it is further possible to provide different gamma characteristics for each of the different colors in a color sequential display.

Using digital pixel drive waveforms to produce gamma values different from one by the above-described technique relying on varying time intervals between the sequence states has significant advantages over the method previously described in U.S. Pat. No. 7,238,105 that relied on constant intervals between the sequence states while the display illumination intensity was linearly ramped. For illuminators that have a maximum allowable output intensity, linearly ramping the intensity from zero to the allowed maximum produces an average intensity of half the maximum, and thus underutilized the illuminator. The scheme described here allows the illumination to be continuously at its maximum value for better illuminator utilization. The degree of illuminator utilization can be quantitatively compared by examining the variance or standard deviation illumination vs. time. In the case of an illuminator whose intensity I is linearly ramped from zero to a maximum value over a time interval of length $\tau(I(t)=I_{MAX}t/\tau)$, the intensity values are uniformly distributed, and thus have a mean value $I_{MAX}/2$ and a standard deviation of $I_{MAX}/\sqrt{(12)}$. For the constant illumination available under the gamma method described here ($I(t)=I_{MAX}$), the mean value is $I_{MAX}$ and the standard deviation is zero. The method described here thus advantageously delivers gamma values greater than one with intensity vs. time functions having fractional standard deviations smaller than or $\frac{1}{2}/\sqrt{(12)}$, or smaller than 28.9%.

Figure 18:
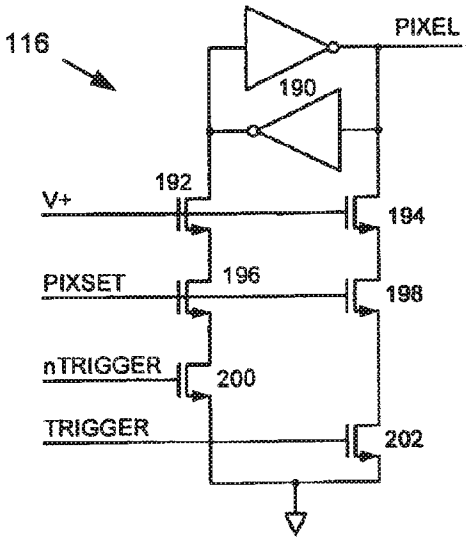
FIG. 18 is a generalized schematic of an alternative pixel driver.

According to a second control method, the circuitry depicted in FIGS. 6, 7, 8, and 18 can be used to generate 'bit-plane' digital gray-scale drive waveforms. These waveforms are similar to those believed to be utilized in current Texas Instruments DLP systems, and similar to those described by Akimoto and Hashimoto in "A 0.9-in UXGA/HDTV FLC Microdisplay," published in the 2000 *SID International Symposium Digest of Technical Papers*, Jay Morreale, editor (Society for Information Display, San Jose, Calif., 2000), pages 194-197. According to such bit-plane methods, the display pixels are set to the value of each gray-scale image data bit for a total time proportional to the bit's significance, with the pixel ON when the image data bit is a 1 and OFF when it is a zero. Although an m-bit gray scale image could be displayed using a bit-plane technique with as few as m updates of the display pixels, in practice the more significant bits are usually "split," and displayed multiple times in several shorter intervals to ameliorate a class of image artifacts usually called dynamic false contouring. In any case, using pixel logic 110 slightly modified from that described previously, only in that pixel driver 116 has its inputs connected slightly differently as shown in FIG. 18, bit-plane digital gray scale can be provided from standard digital video signals with microdisplay data rates and power consumption much lower than according to prior-art systems and methods.

To provide bit-plane gray scale, the image data registers may be divided into an A bank and a B bank to provide double buffering, with writing of input image data as described above. To read out a selected bank, though, the function of sequence generator 92 in control logic 84 is changed so that it sequences through the select/read lines one at a time instead of driving the select/read lines with a ramp waveform, as described above with respect to PWM gray scale. This can be understood in more detail by means of an example.

Again suppose that it is desired for the display system to accept conventional 24-bit color video signals (one 8-bit gray-scale value for each pixel for each of the red, green, and blue primary colors), and convert this input signal to sequential color with bit-plane digital gray scale drive to each pixel, and again that it is desired to double-buffer the image data. As before, this can be accomplished by providing each pixel with 24 register pairs (24 registers in bank A and 24 in B), resulting in each pixel having 24 select/read lines, $S/R_0$ through $S/R_{23}$ (k=1, m=8, p=48, and q=24). Let the registers pairs be numbered as before—input image data to be displayed in red stored in registers numbered 0-7, data to be displayed in green are stored in register pairs numbered 8-15, and data to be displayed in blue are stored in register pairs numbered 16-23, with the least significant gray-scale bits in the lowest register number (0, 8, 16) and the most significant gray scale bits in the highest register number (7, 15, 23). Writing to and reading from the A and B members of the pairs proceeds as before in "ping-pong" fashion: after writing a first frame of data into the A registers, and while a second frame is similarly being written in the B registers, the A-side registers can be read out. The cycle to read out the stored image data proceeds basically as described above with respect to PWM gray scale, but with different programming of the select/read lines. With neither the A nor B data selected (SELA and SELB both low), pulsing the NPRECHG signal low momentarily closes FET switch 150 to provide the logic supply voltage (+V) to the central node 148, pulling it to a high state. When the A field of data is selected, the SELA signal goes high, FET 151 is turned on to enable sensing of the state of the registers on the pixel's A side. In contrast to PWM gray scale where the sequence generator provided a sequence of 8-bit count states to 8 of the S/R lines while the other 16 S/R lines were held low, now the sequence drives only one of the S/R lines high at a time. If it were desired, for example, to first display the most-significant bit (MSB) of the red data, then $S/R_7$ would be driven high while the other 23 S/R lines were held low. This would connect the $OUTA_7$ signal to central node 148 through FET switches 154. If register 7 in a particular pixel were storing a 1, then its output would pull its $OUTA_7$ signal low, which would in turn pull central node 148 to a low condition as well. If register 7 in a particular pixel were storing a 0, then its output would be open, and node 148 would be left high. The states of the other 23 $OUTA_i$ signals not selected (those whose S/R lines are low) are ignored. After the precharge cycle, with the SELA still high, the signal NHOLD ("not hold") goes active low, providing positive feedback around inverter 160. If node 148 is high not actively being pulled low by the $OUTA_7$ line, then this feedback will force node 148 actively high. Thus, this step resolves the state of the TRIGGER line to a full high or low logic level, which level is exactly opposite to the state of the register 7 (i.e. if register 7 stores a 1, TRIGGER will be low and if register 7 stores a 0 TRIGGER will be high). The signal TRIGGER on the output side of inverter 160 will correspondingly have the same level as the bit in register 7.

The signals TRIGGER and NTRIGGER are supplied to pixel driver 116 shown in FIG. 18. Pulsing PIXSET high causes one of FET switches 200 or 202 (depending on which of TRIGGER or NTRIGGER is high) to pull the corresponding side of latch 190 low, which condition remains after PIXSET goes low. In this way the signal PIXEL applied to pixel electrode 118 acquires the same value as that of the bit stored in register 7.

Figure 23:
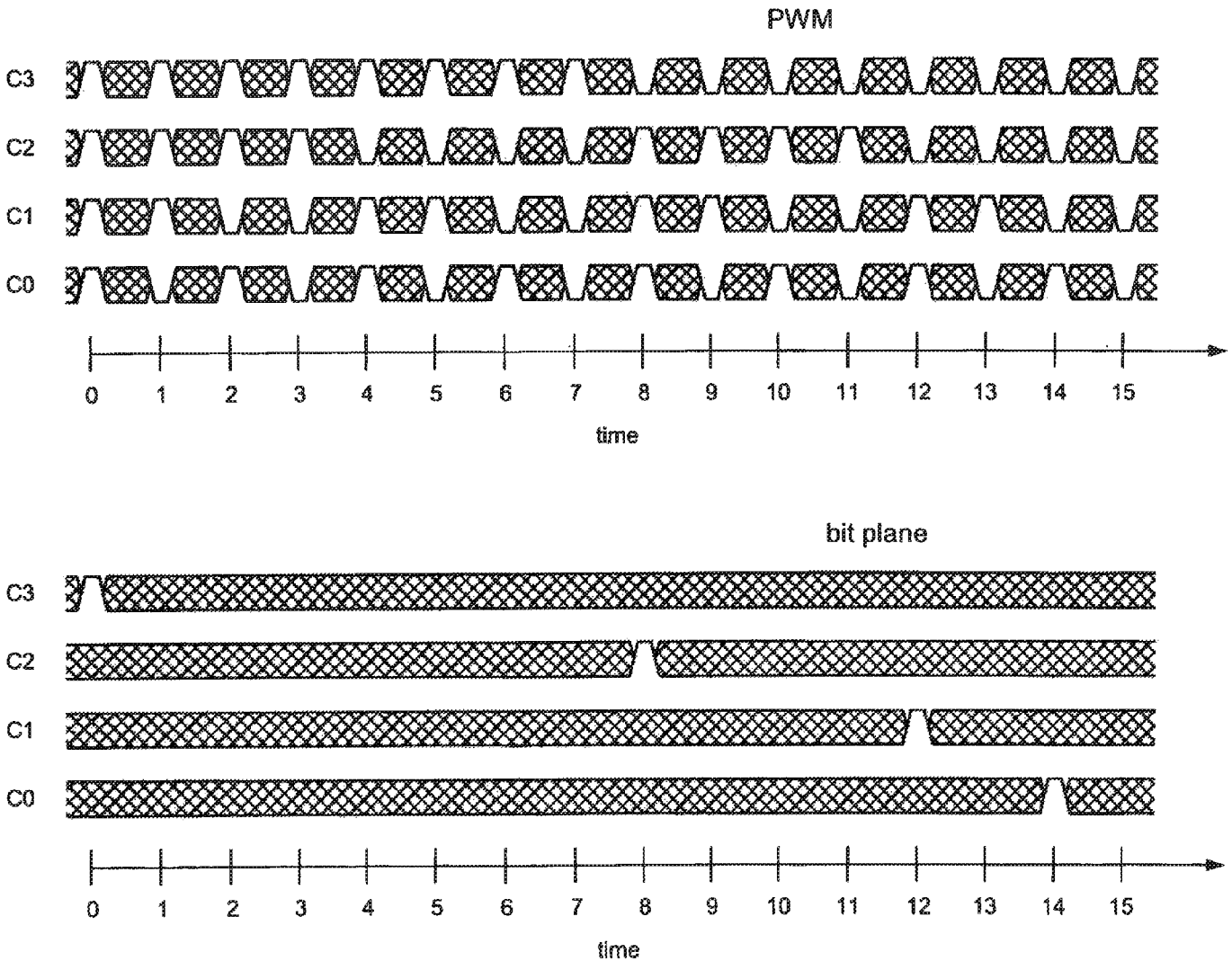
FIG. 23 is timing diagrams for ramp counter states in a first PWM mode and second bit-plane gray scale mode of operating a display.

The sequence of selecting one of the registers by making only its S/R line high, reading out its stored bit by precharging node 148 and activating NHOLD, and then applying the read-out value to the pixel electrode by pulsing PIXSET can be repeated for the other stored image bits, with varied temporal intervals between providing display of appropriate duration according to the significance of the bits. The intervals of display of the more significant bits can be split or not, as desired, and the bits of a given color can be all displayed contiguously before the bits of another color are displayed, or the sequence can go from a first color to the other colors and then back to the first again, provided that the writing of bits to the pixel electrodes is synchronized with the color of illumination of the display. FIG. 23 compares the output of the sequence generator 92 for the exemplary 4-bit PWM case described previously and a 4-bit bit-plane case without any bit-splitting according to the method just recited. In the case of the PWM method, described with reference to the top part of FIG. 23, the image data registers are read out at each of the times indicated by a tick-mark on the time scale (15 total readouts). In the case of the bit-plane method, described with reference to the bottom part of FIG. 23, a pixel register is read out at the times indicated by tick marks 0, 8, 12, and 14. At the time indicated by tick mark 15 all the pixels in the display are written OFF. This can be accomplished, for example, by cycling the decision logic circuit 114 as described above with reference to FIG. 8, but with neither SELA or SELB active, guaranteeing a high state for the TRIGGER signal, and then activating PIXCLR to switch any pixels remaining ON to OFF.

According to either the first digital gray-scale method (PWM) or the second digital gray-scale method (bit-plane), the pixel circuitry 110 described with reference to FIGS. 6, 7, and 8 can also provide refresh of the dynamic registers 112 storing the image data. Using the sequence described above in the bit-plane method a single bit can be read out by activating only one of the set of S/R lines. Then, with NHOLD active, activating the REFRESH line causes FET 158 (shown in FIG. 8) to conduct, writing the read-out bit onto the pixel's local column. From there, activating the register's WRITEA or WRITEB line writes the bit back into its register of origin, restoring the level there to the original value. Keeping the PIXSET and PIXCLR lines low allows the refresh process to proceed without any interference to the state of the pixel electrode. Thus, the refresh process can be carried out as frequently as needed, interspersed between the pixel select/read cycles used in the two digital gray-scale methods described above, allowing even registers with short retention times to be tolerated. It is a characteristic of the present invention that the refresh of the dynamic registers can be carried out in parallel. That is, the restoration of the level stored in a dynamic register 112 of a given pixel can be carried out simultaneously with the level restoration in the dynamic register of another pixel. In fact, the present invention permits this operation to be carried out on all the pixels in a row of pixel at once. The present invention even permits this operation to be carried out simultaneously and in parallel on groups of pixels larger than a row of pixels, in fact it can be carried out simultaneously on all the pixels in the pixel array 80. This parallel characteristic is desirable in that it minimizes the time required for refreshing the entire array of registers, which in turn facilitates interspersing the refresh operation between the pixel select/read cycles used in the gray-scale methods and between the write operations used to store new incoming image data. Further, it facilitates high refresh rates which may be desired or required to accommodate dynamic register designs that result in a fraction of the registers having relatively short data retention times, which designs are often those of the most compact or easily implemented registers.

It is a further characteristic of the present invention that this refresh and level-restoration operation is local. That is, the operation of sensing the level stored in the image data register 112 and restoring it can be performed by circuitry located close to the register. The present invention provides that the sensing and restoration circuitry is located closer to the register than one-half of the length of a pixel-array column (or row), and may, in fact, be with the size of a few pixels such as 48 pixels, or even 12 pixels of the register. In fact, the sensing circuitry can be, according to the embodiments of the present invention, within a distance of six pixels or even one pixel of the register. The present invention further provides that the sensing and restoration circuitry may be utilized only by a small group of pixels, the group containing 48 pixels or fewer, or even that the sensing and restoration circuitry be utilized by only a single pixel. This characteristic of local sense and refresh has the advantage that power consumption is minimized, since the energy used in a refresh operation is determined by the energy associated with charging and discharging the wiring that interconnects the register and the sense/restore circuitry.

Applicants have found that, although it is feasible to design dynamic registers with median retention times of many milliseconds, a small fraction, say perhaps somewhat less than 100 parts per million (ppm) might have retention times shorter than 100 μs. An even smaller fraction, perhaps 10 ppm, might have retention times shorter than 10 μs. It is possible to increase register retention times, for example by increasing the area of the gate of FET transistors 132 and 138, but this might undesirably increase the minimum achievable size of the pixel. Thus, it may be advantageous that the pixel registers be refreshed at a rate higher than the 50 Hz or 60 Hz rate at which new video data is supplied, or even higher than AS sequential-color color field rates, which typically fall in the range of 150-720 Hz. It may even be advantageous to have refresh rates higher than 1 kHz, or even higher than 1 kHz, all of which are feasible with the pixel circuitry 110 described above.

Figure 19:
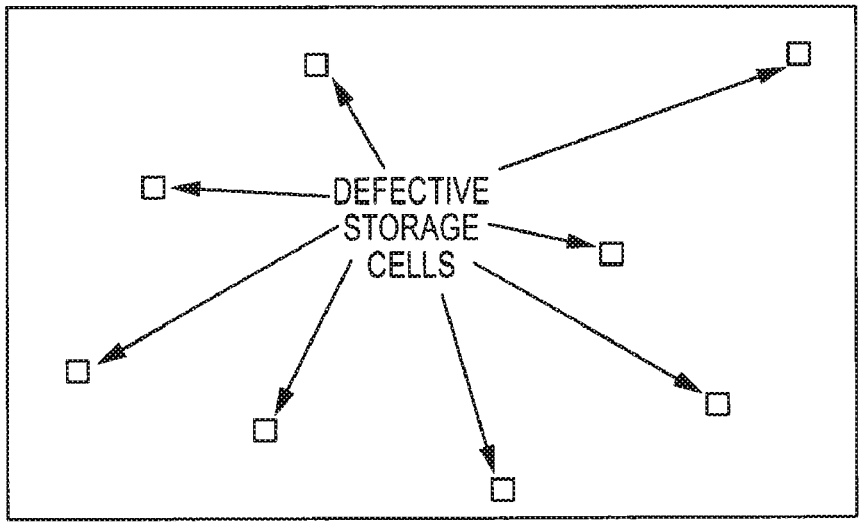
FIG. 19 is an illustration of a plurality of defective storage cells in an array of memory registers.
Figure 20:
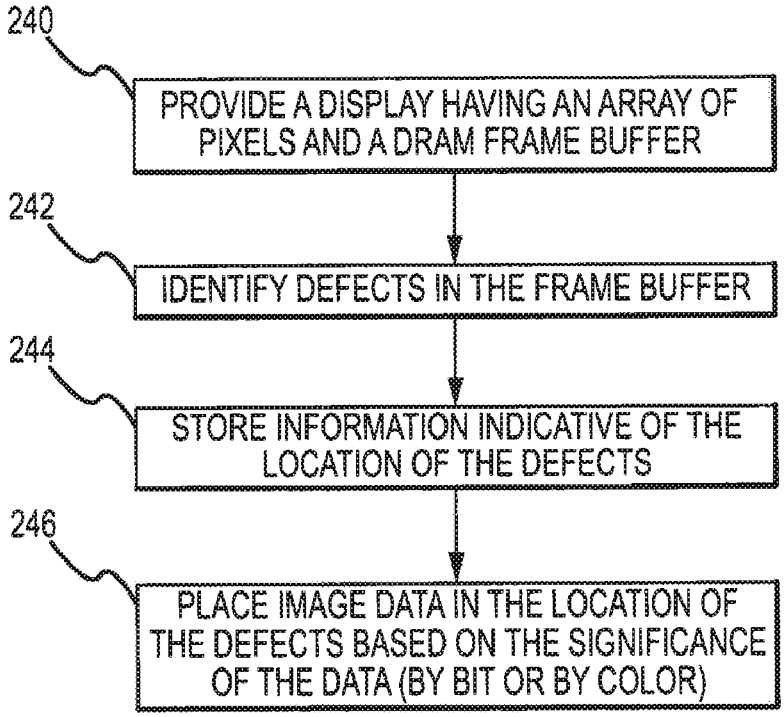
FIG. 20 is a flowchart of a process for minimizing the effect of defective memory registers and a display.

With the LCOS display panel 64 described herein, it is possible to minimize the impact of defective storage registers on the displayed image. FIG. 19 shows the LCOS panel with a number of defective storage registers or cells located therein. In a worst-case scenario, a defective storage register at a particular location in the display might contain the information for the most significant bit of the color to which the eye is most sensitive (green). It is possible to map these defective storage cells to instead contain less visually significant or noticeable information, for example, the least significant bit of the less easily perceived colors (blue and red) at these locations in the display. The process shown in FIG. 20 describes how this is done. First, in process step 240, a display or microdisplay like the one previously described is provided having an array of pixels and a DRAM frame buffer. As described herein, the DRAM frame buffer is distributed throughout the pixel array, however this process would also work in a situation where the DRAM frame buffer was not distributed throughout the array or even if the frame buffer used a type of memory cell other than DRAM. Next, the defects in the frame buffer are identified in process step 242. These defects can be identified in any number of ways, including visual inspection and automatic testing. After this, information indicative of the location of the defects is stored in one or more memory registers in process step 244. For example, these memory registers may be in the storage unit 98 associated with the control unit 84, which storage unit could include non-volatile memory so that the testing operation need only be performed once. Alternately, these memory registers could be on the backplane of a microdisplay and the location of the defects could be determined by built-in self test every time the microdisplay was powered on. Subsequently, in process step 246, a mapping process is performed so that image data placed in the location of the defective storage cells is based on the significance of the data, both by bit and by color. For example, the first defective cell could be used to contain the least significant bit of the color blue or red, since the eye is less sensitive to these colors than to green. Additional defective cells in the area of that same pixel could be used to contain the next least significant bit of one of the less significant colors, and so forth.

One embodiment of the above mapping process relies on a row-by-row mapping. Suppose that somewhere in one of the display's rows of pixels there were a defective memory cell (say, a cell that would store an it bit of the q image data bits associated with that pixel) that would, if not otherwise mapped, correspond to an image data bit of high visual significance. This defective cell is written to by activating one of the $i^{th}$ writeA or writeB lines and read or selected by activating the $i^{th}$ read/select line. Hereinafter, this situation will be referred to as the defective cell being in the $i^{th}$ register row. (Thus, the display has N pixel rows and each pixel row has q register rows.) Programmable circuitry in the row control/select block 88 could be used to swap, for this pixel row, all the memory cells in the $i^{th}$ register row with the cells in another register row, say the $j^{th}$ row. This would improve the appearance of the display provided that there were no defective memory cells in that pixel row's $j^{th}$ register row, and provided that what was originally the $j^{th}$ bit of the q image data bits was of less visual significance that what was originally the $i^{th}$ bit. Suppose further that it was determined that of the q gray-scale bits it would be acceptable to re-map as many as r of them in any pixel row. For example, if defects were tolerable in the least significant green bit and in the two least significant blue and red bits, then r would have the value of five.

Figure 24:
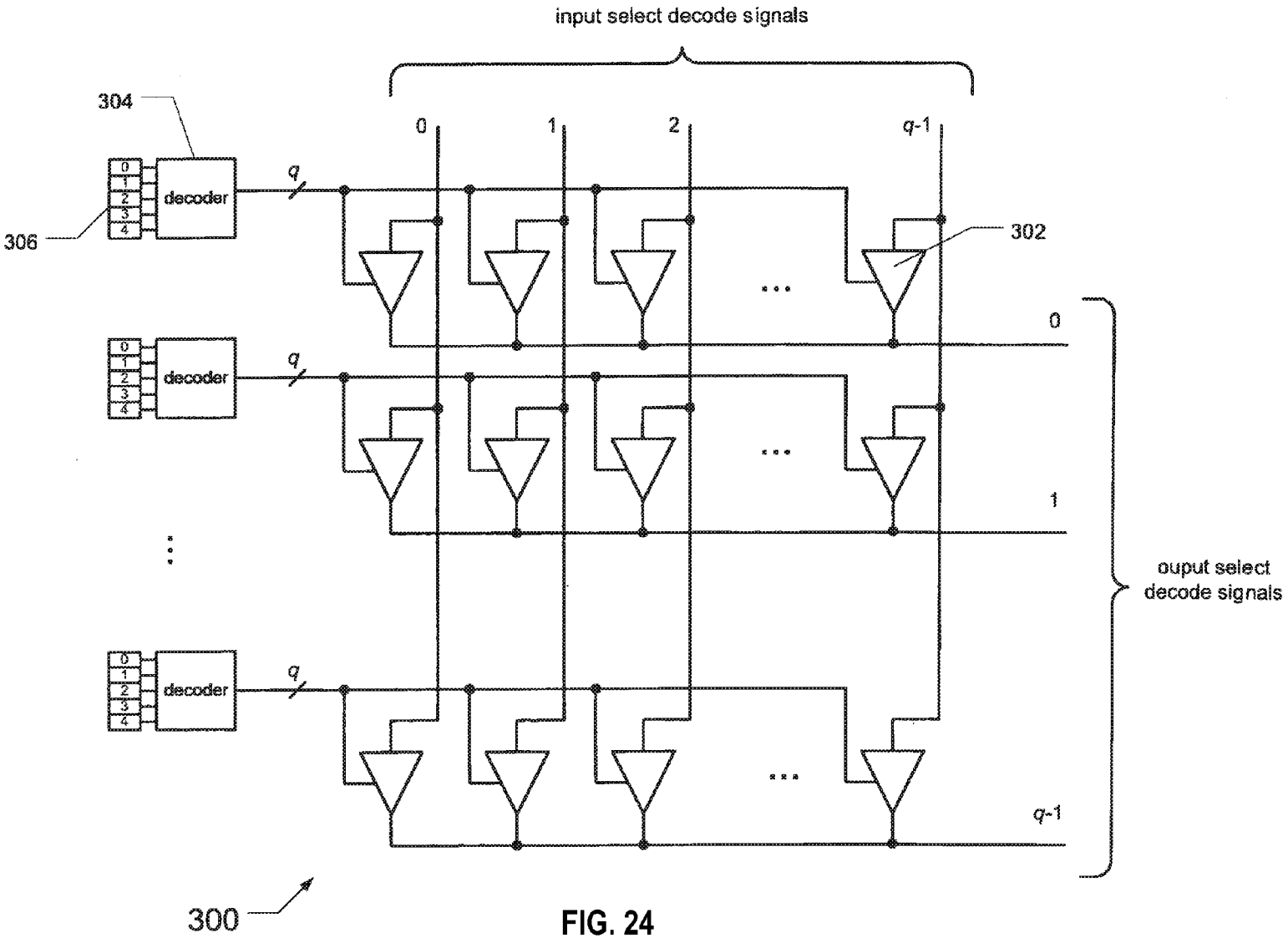
FIG. 24 is a block diagram of a map decode circuit for re-mapping defective memory cells in a given display row to less objectionable gray-scale values.

Then a given display with defective memory cells corresponding to no more than r register rows in any pixel row could be made acceptable by row-based re-mapping. Such row-based re-mapping could be implemented by many different techniques, of which one will be described with reference to FIG. 24, which shows a map decode circuitry block 300. Previously described row control/select circuitry 88 would include one such block for each pixel row (or for each group of co-addressed pixel rows). The map decode circuitry block 300 comprises tri-state buffers 302 arranged in a q×q array. If one and only one buffer 302 in each row and in each column of the array has its output activated, then the array functions as a cross-point switch to map q input select decode signals to q output select decode signals. To determine which of the buffers 302 have their outputs activated, a decoder 304 and bank 306 of latches is associated with each row of tri-state buffers. It is sufficient that each bank contain the smallest number greater than $\log_2 q$ latches; in FIG. 24 each bank is shove as containing five latches (which is appropriate for q=24), but other bank sizes could be used as appropriate. The select decode signals are used for both memory write and select/read operations, so the mapping is transparent to the controller 84.

The circuitry can be operated as follows to map defective memory cells so the effect of the defect is inoffensive or imperceptible. The locations of the defective registers in the array of pixels are first found by testing as described above with respect to FIG. 20. For each defect, only which pixel row it occurred in and, within that row, which register row it occurred in need be noted, the defective cell's pixel column is irrelevant. A pixel row may have no defective cells, a single defective cell, or more than one defective cell. Then, to operate the display, the banks of latches 306 are loaded, for instance according to the following method. A ranking is assigned to the q different image data bits according to their visual significance. The green MSB might be assigned 1 for most visually significant while the blue LSB was assigned 24 for least visually significant. The other bits would have intermediate ranking. The overall ranking scheme could be defined in a way that depended on the intended use of the display. An exemplary ranking is portrayed in the BIT VALUE column of the table in FIG. 25. In general, but not necessarily, the same ranking would apply for every row in the display. For each row of pixels, the circuitry of controller 84 scans through defects noted for the q register rows. The first non-defective register row is assigned to the visually most significant bit. The first defective register row is assigned to the visually least significant bit. This process is continued, with non-defective register rows being assigned to bits of ever decreasing visual significance and with defective register rows being assigned to bits of ever increasing visual significance, until all register rows for a given pixel row are assigned. The assignments are recorded by writing the appropriate bits in the latch banks 306. The table in FIG. 25 shows the results of mapping for a hypothetical exemplary pixel row in a $q \geqq 24$ bit display. In this pixel row, testing revealed defective memory cells in register rows 3, 7, 9, 12, and 17. Thus, register row 3 is mapped to correspond to the bit of lowest visual significance, which is the blue LSB (B0) in this example. Similarly, defective register row 7 is mapped to the red LSB (R0), register row 9 to the green LSB (G0), register row 12 to the blue next-to-LSB (B1), and register row 17 to red next-to-LSB (R1). The values recorded in each latch bank 306 to effect this mapping are shown in the rightmost column of the table. The loading of the latch banks for all the display pixel rows proceeds in a similar fashion. If more than a critical number r of defective register rows are detected for a given pixel row, then the display can be regarded as unacceptable, but otherwise the mapping of defects produces a display of acceptable quality.

After all the latch banks are loaded the display can be operated as described with reference to FIGS. 5 through 18. When it is desired to write or select and read image data corresponding to the $i^{th}$ bit of image gray-scale data, controller 84 activates the $i^{th}$ input select decode signal provided to map decode block 300. The map decode block 300 then maps this signal to an output select decode signal which is in turn provided to WRITEA, WRITEB, or S/R lines depending on whether input image data was being written to the A or B block or whether the stored image data was being read back to provide input to the decision logic block 114 or to refresh the image data memory cell. In the instance of writing incoming image data, the controller 84 might activate input select decode signals for a single pixel row, while for read out or refresh it might simultaneously activate input select decode signals in all pixel rows.

Although in the above description of error mapping the mapping is described as operating on rows, it is to be understood that this aspect of the present invention is not to be limited to row-based mapping, but can be used with pixels or registers connected into any desired logical group.

Other techniques may be useful for minimizing the effect of defective memory cells on the displayed image quality. If a memory cell is more likely to fail by sticking one way than the other, the polarity of the data stored in the storage cells can be selected so as to provide a situation where the more probably failure of a storage cell would result in a darker pixel than intended, rather than a brighter pixel than intended. As an alternative to mapping defective cells from one image data value to another, extra memory cells can be provided in each pixel row. For example, to display images with 8-bits of gray-scale information for each of three colors with double-buffering to prevent the tearing artifact, 48 registers are needed per pixel. The display design could provide more than 48, for example 50, registers per pixel. Then when a defective register row was discovered an extra row could be mapped in its place using the same type of map decode circuitry described with reference to FIG. 24. The fault-tolerance technique of mapping from one image value to another will allow pixels with fewer transistors and hence smaller areas than pixels with redundant memory cells, though. Alternately, for the same size pixel and same pixel circuit complexity, the fault-tolerance technique of the current invention will generally result in higher display backplane yields than would the redundancy technique. A defective memory cell generally means in the embodiment described with reference to FIG. 7 that one of transistors 130, 132, 136, or 138 is fault. A similar mapping technique can also be used to provide tolerance to defective transistors in decision logic unit 114 described with reference to FIG. 8. For example, the transistors 154 or 156 responsible for the select/read function might fail by being conductive even when their s/R line was low. This could prevent the decision logic circuit from ever producing a trigger signal, causing the defective pixel to never turn OFF, even if the offending register row were mapped to low visual significance. This defect can be tolerated by testing the display to find such defects, noting their location (for example in non-volatile memory 98 or in memory registers on backplane 70), and then designing the controller to always write a 0, regardless of the input data bit, to the corresponding memory cell. With this additional mapping such a defect will be rendered essentially harmless.

The fault detection and re-mapping feature of the present invention as described above operates to reduce the visual significance of defects in the frame buffer registers and pixel circuits. This means that after the fault detection and remapping process is completed a human viewing the display sees a more pleasing displayed image than if the process had not been carried out. The detectability of defects in the buffer memory and pixel circuits by the eye is reduced by carrying out the process compared to what it would be otherwise. At error rates in the range of a few hundred parts per million carrying out the described process can transform a display with glaring pixel defects into a display with no defects detectable under normal viewing conditions.

Figure 29:
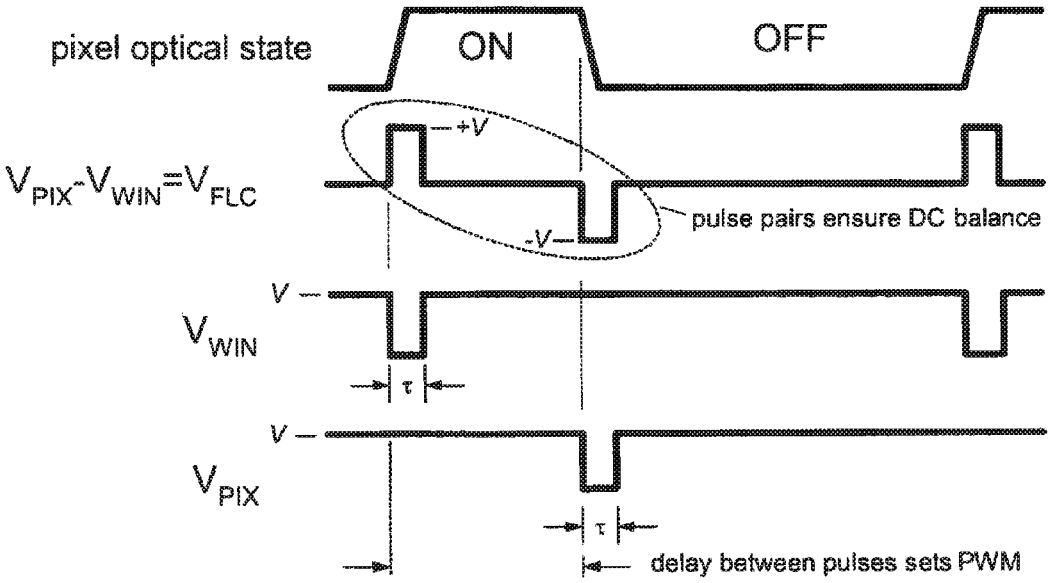
FIG. 29 is timing diagrams for bistable pixel drive.
Figure 30:
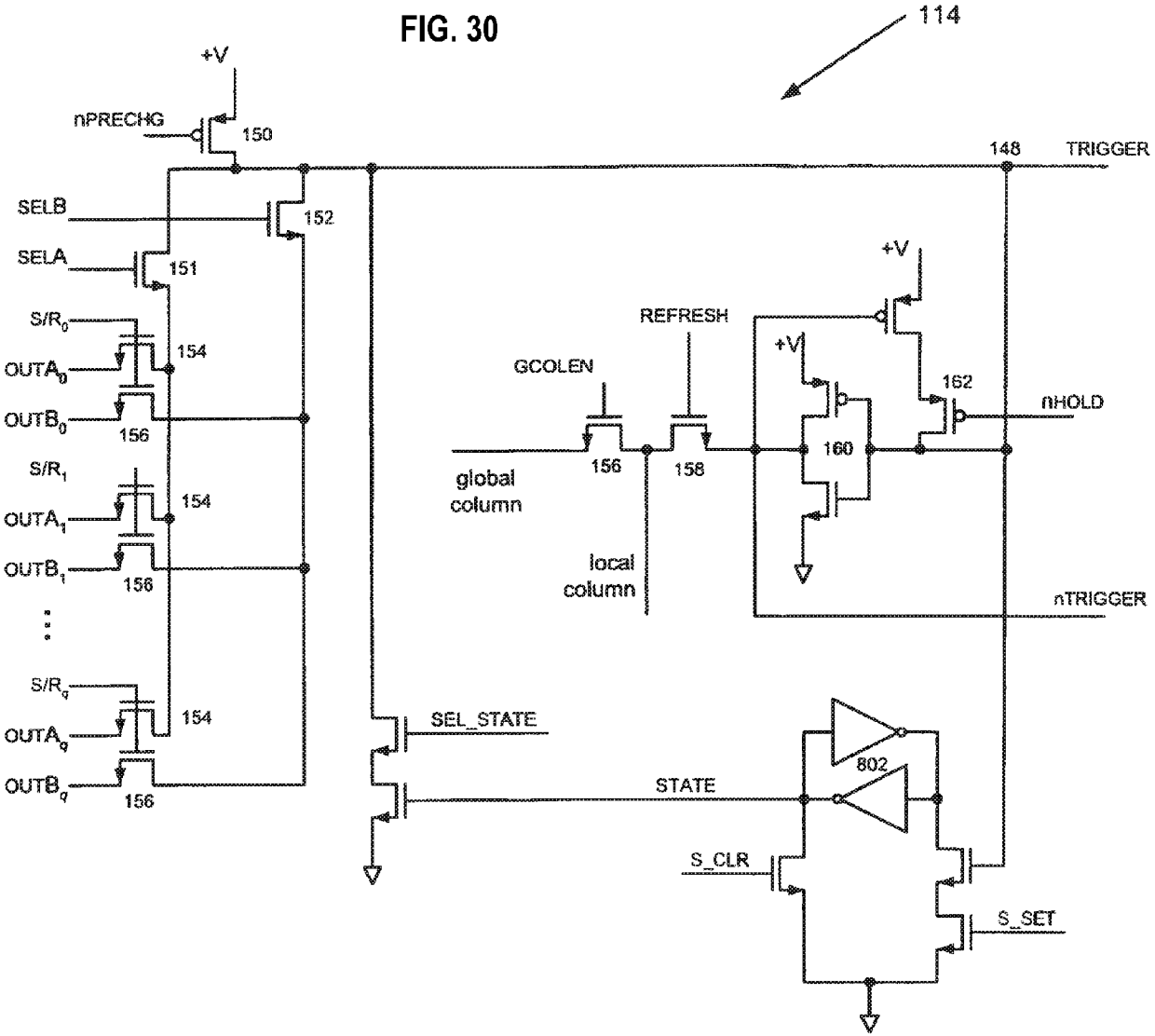
FIG. 30 is a generalized schematic of portions of the select/read and decision logic of FIG. 6, adapted to bistable pixel drive.

The invention, including the circuitry described above with reference to FIGS. 7, 8, and 9 can also be used to generate digital pixel drive waveforms appropriate for driving bistable FLC, pixels with pulses. Bistable FLC devices or pixels are typically driven with three-level electrical signals that may take on the values +V, −V, and 0 V. A positive +V pulse switches the FLC to the ON state; a negative −V pulse switches it to the OFF state. After a switching pulse is complete the device drive is set to 0 V (short circuit). The bistable memory characteristic of the device causes it to retain its last switched optical state indefinitely while 0 V drive is applied. An embodiment of the invention can generate such three-level drive by simultaneous actuation of the conductive window electrode located on an inner surf-ace of the glass 72 and the pixel electrodes. It is typically desirable for the +V and −V, states to be present only for a short time period $\tau$ as illustrated in the in FIG. 29. As illustrated, the pulses can be easily generated if the pixel electrode driven to a voltage different from the voltage applied to the window electrode for the time period $\tau$. One embodiment of the invention causes the pixel electrode to be in the +V or −V state for a desired time period τ by the addition of a second sequence generator and by adding a latch to the circuitry of each pixel to indicate the completion of the pixel electrode pulse. First, all the pixel electrodes are set to the +V state, while the window electrode is driven to 0 V. After the desired time period has elapsed, the window electrode is driven to +V. This process creates the first +V pulse, turning all the pixels ON and then returning the voltage difference across the pixel to 0 V (even though at the end of the process the pixel electrode 118 is being held at +V). As previously described with respect to the embodiment detailed in FIGS. 7 and 8, a first sequence generator then proceeds to down count, the pixel decision logic unit acting with PIXCLR active so that when the first trigger event occurs the pixel electrode is switched to the 0 V state (applying a −V voltage difference across the pixel). This first trigger event occurs after a time period dependent on the pixel's stored image data value. After the first sequence state that produces the trigger event that sets the pixel electrode to 0 V, subsequent trigger events do not have any effect as the pixel electrode state is already at 0 V. At a time interval of τ after the beginning of the first sequence generator's sequence, a second sequence generator begins outputting the same sequence of states employed by the first generator, its output being alternately multiplexed onto them same set of pixel select/read lines. While acting on states from the second sequence generator, the pixel decision logic unit acts with PIXSET active so that resulting trigger events cause the pixel electrode to be set to the +V state (returning the voltage difference across the pixel electrodes to zero). The action of the second sequence generator is then to terminate the −V pixel electrode pulse. Subsequent matches from the first sequence generator would tend to drive the pixel electrode to an undesired state. By the addition of latch 802 to the pixel decision logic unit, as shown in FIG. 30, such subsequent, matches from the first sequence generator can be avoided. The latch is initialized at the beginning of a video field by momentarily activating the S__CLR line such that the latch output STATE is a zero. The line SEL__STATE is held high each time a decision is to be made based on a sequence element provided by the first sequence generator, and hence state of the added latch 802 will be a factor in the decision, allowing the TRIGGER to go high only if the latch state makes STATE low. Following each second sequence generator calculation, the line S__SET is pulsed high. The first trigger event from the second sequence (i.e. the one that causes −V pulse termination) will cause latch 802 to flip, resulting in output STATE going high. After latch 802 has been written to have STATE high, no subsequent decision result from the first sequence generator will result in a trigger event, as STATE and SEL__STATE will act to always discharge dynamic node 148, and thus the pixel electrode will remain at the +V state.

DC balance of the liquid crystal pixel can be ensured by generating pulses as described above by alternately switching the window electrode and the pixel electrode between the same voltage values (0 V and V) for time intervals of the same duration τ, and always alternately applying pulses of opposite sign.

Figure 26:
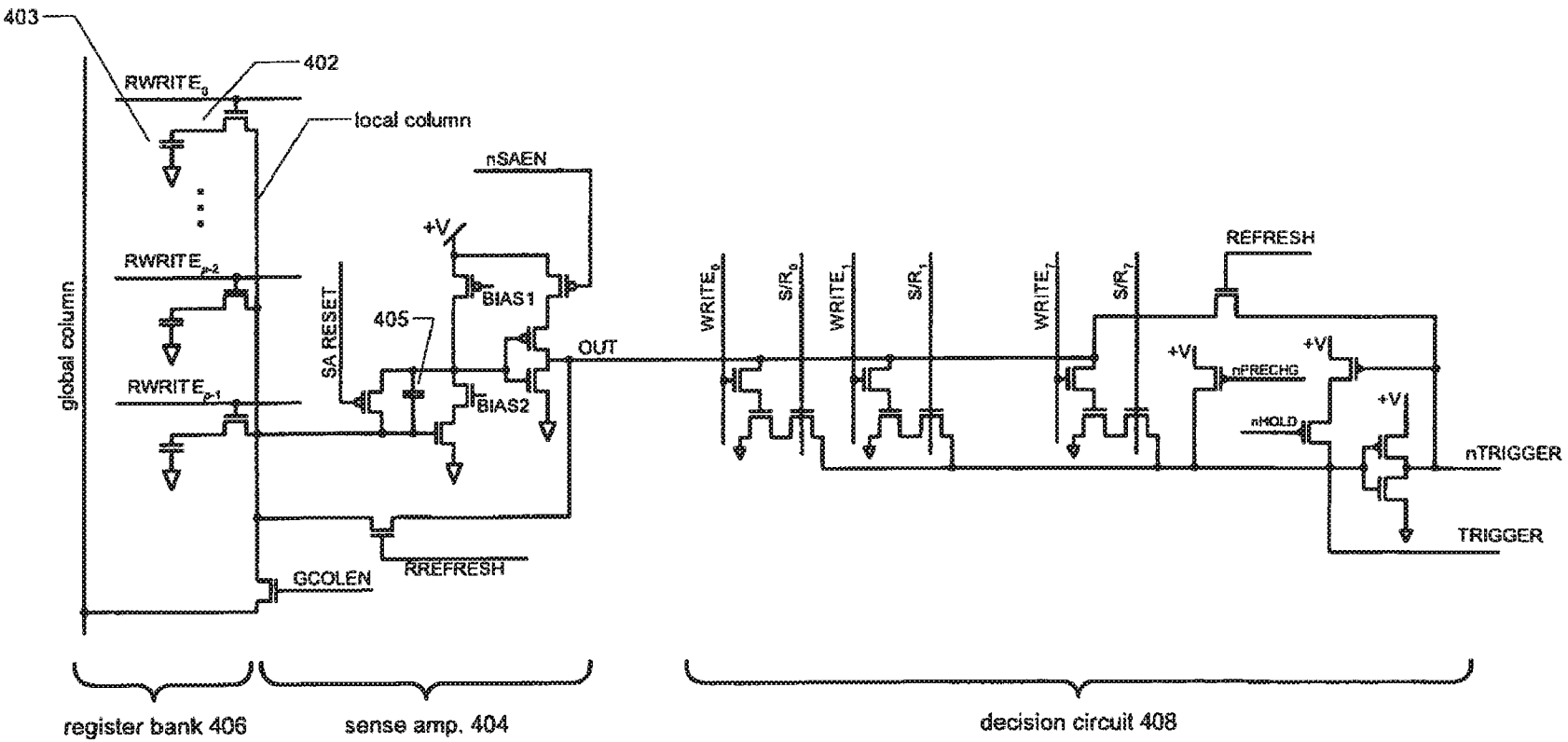
FIG. 26 is a generalized schematic of portions of pixel control logic of FIG. 15.

FIG. 26 shows another embodiment of the invention. This embodiment utilizes the so-called one-transistor (1T) DRAM memory register. The 1T register, as shown as element 402, comprises a single transistor and a capacitor 403. This register has an extremely compact layout, but requires a more sophisticated readout circuit, shown in FIG. 26 as sense amplifier 404. The left portion of FIG. 26 shows a bank 406 of p memory registers addressed by p write lines (here called RWRITE for register write) and a local column line. The local column is also connected to the input of sense amplifier 404. As described previously with respect to FIG. 6, the input image data to be stored in the registers is transferred from column control unit 86 to the global column, and then onto the local column when GCOLEN is high. The register is loaded by pulsing the RWRITE line high, which charges the register capacitor 403 to the voltage of the local column line (at least to within one transistor threshold of the voltage of the local column line). It is read out by again activating the RWRITE line, at which time register capacitor 403 shares its stored charge with the capacitance of the local column node. The more compact 1-T register requires a sense amplifier 404, which could be provided by the seven-transistor circuit shown in FIG. 26. Prior to a read, sense amplifier 404 is initialized by a pulsing the SA RESET (sense amplifier reset) line, which discharges integrating capacitor 405, and brings the input to an intermediate voltage determined by the levels of BIAS1 and BIAS2. Then, the selected register's RWRITE line is activated, connecting the register capacitor 403 to the sense amplifier input. The flow of charge as the register capacitor discharges into the amplifier input is integrated on small sense amp capacitor 405, producing a large voltage chance at the input to the sense amp's output buffer inverter. FIG. 26 also includes decision logic unit 408, which utilizes a concept similar to that described previously with respect to FIGS. 7 and 8, but since the primary image data storage is now in register bank 406, the decision circuit 408 need only have as many elements as the number of bits in one gray-scale image value. For example, with a 24-bit image representation comprising three 8-bit gray-scale values, one for each color, decision circuit 408 need only have eight inputs. This is the case, shown only for example, in FIG. 26. After a given bit is read out of register bank 406 by sense amplifier 404 it can be output (by enabling the sense amplifier output by pulling NSAEN low) and stored on a selected input of decision circuit 408 by activating a selected one of the decision circuit's WRITE lines. After all the inputs of the decision circuit are loaded, a complete gray-scale image value having been read out, a gray-scale pixel drive waveforms can be generated by applying the output of the sequence generator to the decision units S/R lines, in a manner similar to that described previously with regard to FIGS. 10, 11, and 23. As before, the decision unit's output trigger lines connect to pixel drive circuits like those described with regard to FIGS. 9 and 18. Refresh of the register values and of the decision unit input values is provided by activating the RREFRESH and REFRESH signals, respectively.

Another embodiment of the present invention can be used to provide analog pixel drive waveforms implemented with digital control signals. Certain ferroelectric liquid crystals are know to exhibit an analog switching characteristic know in the art as "V-shaped" switching, as described by M. J. O'Callaghan et al. in "Charge controlled, fixed optic axis analog ('v-shaped') switching of a bent-core ferroelectric liquid crystal," Applied Physics Letters volume 85, pages 6344-6346 (2004), and in "Switching dynamics and surface forces in thresholdless "V-shaped" switching ferroelectric liquid crystals," Physical Review E volume 67, pages 011710-011712 (2003), and in "High-tilt, high-Ps, de Vries FLCs for analog electro-optic phase modulation," Ferroelectrics volume 343, pages 201-207 (2006). It has been found that improved analog switching characteristics can be obtained under drive conditions where the analog value of the pixel drive charge is controlled by the drive circuit (rather than the more usual case where the drive circuit controls the drive voltage).

Figure 27:
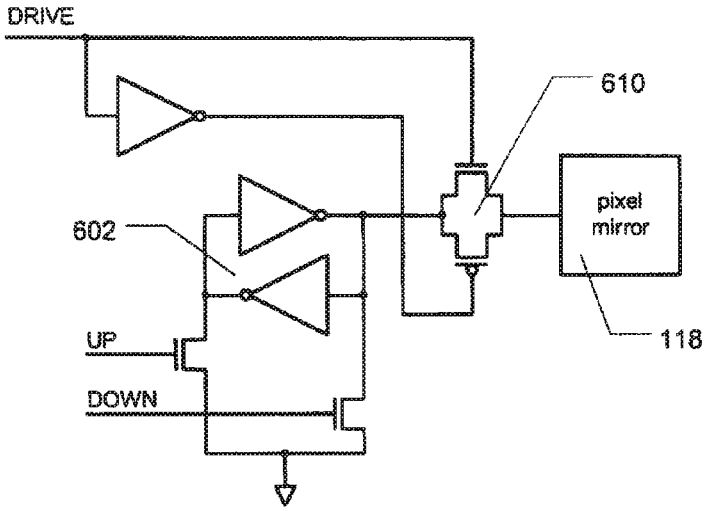
FIG. 27 is a generalized schematic of portions of a pixel driver of FIG. 6.
Figure 28:
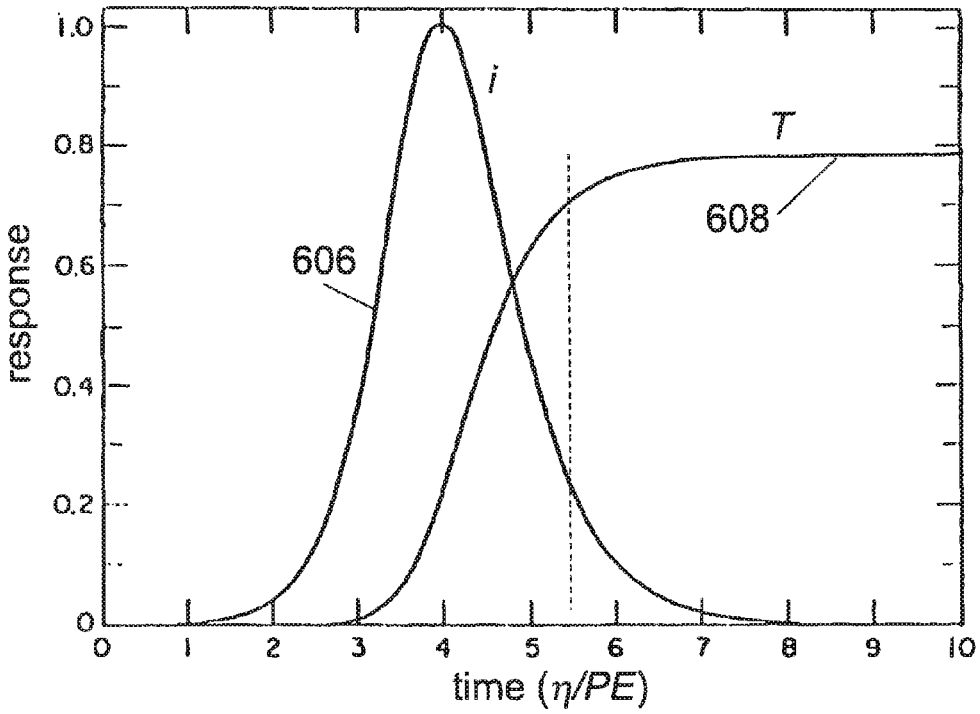
FIG. 28 shows generalized optical and electrical switching characteristics of a liquid crystal pixel.

Constant-charge pixel drive can be provided by a digitally-controlled circuit that relies on the time response of the FLC polarization to a drive step using, for example, the pixel drive circuit shown in FIG. 27. With the DRIVE signal low so that transmission gate 610 is open and the output of latch 602 is disconnected from the pixel mirror electrode 118, the output of the latch can be set to a high or low state by pulsing the UP or DOWN line active, respectively. Then, upon pulsing the DRIVE line high, the latch output voltage will be applied to FLC material lying over the pixel mirror 118. Assuming that the initial FLC state is such that the latch output level will act to switch the FLC to its opposite binary state, a switching current 606 $i(t)$ like that shown FIG. 28 will flow from the latch output onto the mirror electrode during the time that the optical response T 608 is changing (the time scale here is in scaled units of $\eta/PE$, where $\eta$ is the FLC orientational viscosity, P is its spontaneous polarization, and $E=V/d$ is the electric field produced from the latch drive voltage V across the FLC device thickness d). As can be seen, late in the switching process the optical response has nearly reached its saturated state but significant current continues to flow. If at this point (marked by the dashed vertical line) the DRIVE signal goes low, transmission gate 610 will go open-circuit, and the FLC pixel will be electrically isolated from the driver and no further charge will be allowed to flow onto its electrode. Thus, the amount of charge supplied can be controlled by controlling the time during the switching process at which the DRIVE signal is brought low. After this, the polarization P will continue to reorient and the voltage across the FLC will drop as the dielectric part of the FLC capacitance is discharged. If the DRIVE signal has been dropped low not too late in the switching process this process will be able to consume all the charge left on the pixel electrode, and the voltage across the device will fall close to zero.

The time during the switching process at which the DRIVE signal is brought low can be controlled using stored data and decision logic as described above with reference, for example, to FIGS. 7 and 8. Thus, pixels according to one embodiment of the present invention can be constructed using pixel registers to store pre-determined pixel gray-scale values, decision logic acting in concert with a sequence generator to produce digital pixel timing signals, and a pixel drive 116 such as the circuit shown in FIG. 27 to selectively drive and open-circuit the pixel electrode in response to the digital timing signals, in a way that produces an analog pixel charge drive and corresponding pixel analog optical response dependent on the pre-determined stored digital pixel gray scale value. For example, the pixel decision logic generates a trigger signal, as previously describe, which trigger signal determines when the state of the DRIVE signal in FIG. 27 is changed.

For typical FLC materials both the switching charge $2P_s$ and the switching time vary with temperature. In the case of the "switch & open" driver described with reference to FIG. 27, this means that the duration of the DRIVE-high interval should be varied with temperature. There are many ways these variations can be accomplished. The $P_s$ and switching time properties of the FLC material can be characterized in advance. Then, by equipping the LCOS or other device with a temperature sensor, the device can adjust the drive conditions and parameters in accordance with tabulated material parameters in response to the sensed temperature. In the case of the "switch & open" driver, the timing of the DRIVE pulse could be adjusted by control logic that was responsive to the sensed temperature.

As an alternative to relying on advance characterization of the FLC material parameters, they could be sensed in situ as described below. For example, a circuit could be integrated into the LCOS backplane to sense the current from a "reference" pixel, located perhaps on the periphery of an active pixel array. If the pixel electrodes of the main pixels in the array were to be driven from 0 V (OFF) to $V_{DD}$ (ON), with the common window electrode biased at $V_{DD}/2$, the reference pixel circuit could mimic these conditions by biasing the pixel electrode at $V_{DD}/2$. Then, occasionally, the window electrode (at least the portion of it overlying the reference pixel) could be pulsed from 0 V to $V_{DD}$ and back to mimic the drive conditions of the active pixels. The sensing circuit, configured, for example, as an integrator, would provide an output voltage proportional to the charge that flows into the reference pixel. By sampling the integrator output with an analog-to-digital converter, the magnitude and dynamics of the pixel charging could be provided, to the control logic. Thus, the control logic would "know," for operating conditions present at some chosen instant, what the magnitude of the FLC switching charge was, and how long it took to switch to, say, 95% of that value. These parameters could be stored in local memory and then used to set drive parameters the duration of the DRIVE pulse.

Charge-control drive reduces FLC v-shaped switching hysteresis by a factor of 30 compared to voltage-source drive, without the undesirable consequence of increased saturation voltage, and can reduce small-signal optical response rise and fall times by a factor of compared to the response times obtained with voltage-source drive.

While the benefits of charge-control drive for controlling the intermediate FLC device states needed for analog modulation are described above, this type of drive may also provide benefits for devices relying on binary FLC switching. Consider that the electrostatic explanation for V-shape analog switching, as described by N. A. Clark, et al. in "Electrostatics and the electro-optic behaviour of chiral smectics C: 'block' polarization screening of applied voltage and 'V-shaped' switching," Liquid Crystals vol. 27, pp. 985-990 (2000) models the FLC material as a slab of uniform polarization, which occurs when FLC spontaneous polarization is high. Ferroelectric charge $\sigma_F$ on the surface of the slab is determined in the usual way by the orientation of the polarization vector P, with $\sigma_F=P\cdot\hat{s}$, where $\hat{s}$ is unit vector normal to the surface of the slab. Provided that the charge $\sigma_A$ applied by the external drive circuit is smaller than the FLC's spontaneous polarization $P_s=|P|$, then, according to this model, P just takes the orientation that makes $\sigma_A+\sigma_F=0$. This implies that the electric field within the liquid crystal is zero. According to this model, the behavior of the ions that cause image sticking—the elimination of which usually necessitates DC-balanced drive—will be quite different in high-polarization materials than in low-polarization materials, especially under drive conditions which do not apply too much electrical charge to the device electrodes.

Image sticking is caused by electrical fields produced by the separation of free ions within the FLC material. The electrical fields modify the applied electric fields, producing a drift of device electrical characteristics which manifests itself as a slightly visible residue of previously applied image pattern. The ion separation is driven by applied electric fields in the regions of non-zero ionic concentration, i.e. non-zero fields within the FLC material. As described above, the use of a high-polarization FLC material can substantially reduce the electric field within the liquid-crystal material itself. Thus, the action on any ions with the FLC is also substantially reduced, so the ions have much less drive to separate and produce unwanted internal electric fields. While FLC materials with polarizations in the range 15-30 $nC/cm^2$ have typically been used for binary-switching applications, the polarization-stiffening effects that tend to exclude applied electric fields become most apparent at polarizations of 100 $nC/cm^2$ or greater. The benefit of using high-$P_s$ materials is that bringing the time-average of the applied voltage to zero is no longer the only way to reduce image sticking. By allowing drive waveforms with an unbalanced ratio of ON and OFF durations that still produce small amounts of or no image sticking, optical duty cycle and light throughput of FLC devices can be essentially doubled As described herein, the use of especially high polarization FLC materials combined with new drive techniques provide unexpected advantages for the operation of FLC electro-optic devices. For analog operation, a new "switch & open" drive provides an especially compact driver implementation suitable for LCOS devices. For binary operation three principles, each effective on its own but more effective when combined with the others, provide freedom to vary drive waveforms away from DC-balance while preserving low image sticking:

1. use FLC materials with high spontaneous polarization, preferably higher than the about 30 nC/cm$^2$ typical of materials now used for binary switching, even more preferably higher than 60-70 nC/cm$^2$, and still more preferably higher than 100 nC/cm$^2$;
2. use drive circuitry that provides a high output impedance to the FLC modulator, preferably an open-circuit condition when the modulator is not actively switching;
3. operation of the drive circuitry so that it provides just enough electrical charge, and not substantially more than enough, to bring the FLC modulator to the desired optical state.

The display systems and microdisplay panel described above have a number of advantages over previously disclosed systems. For example, as was described above, a shift-register-based system for buffering and re-sequencing image data and providing a PVM drive signal would require 772 transistors per pixel in the case of image data consisting of three colors with 8-bits of gray scale per color. By contrast, in the case of the embodiments of the present invention described with reference to FIGS. 6, 7, 8, and 9, the number of transistors per pixel is greatly reduced. In the case of the input image data having p bits per pixel (i.e. p=24 for three-color display with 8 bits of gray scale per color), the register-pair circuitry of FIG. 7 would require 4p transistors while the select circuitry of FIG. 8 would require a further 2p transistors, with the read circuitry of FIG. 8 having nine further transistors independent of the value of p. Thus, absent the ten transistors of the pixel driver of FIG. 9, each pixel would require 6p+19 transistors (6p+19 if the pixel driver were included). In the case of p=24, each pixel of the present invention would thus need 153 transistors, compared on an even basis to the 772 needed for the previously-described shift-register implementation. If both implementations used the same 10-transistor pixel driver circuit, then the comparison would be 782 to 163 transistors. For the circuitry described in FIGS. 6, 7, 8, and 9 the total number of transistors needed per pixel per bit of input image data depth ranges from 8.4 for p=8 (as might be the case for a monochrome display using digital gray scale), to 7.9 for p=10 (as might be the case for a monochrome display with greater bit depth), to 6.9 for p=21 (as might be the case of a color display where the 256 gray levels/color were achieved by one LSB of frame-to-frame temporal dither), to 6.8 for p=24. Applicants have found that for the case of p=21 (145 transistors total per pixel), the pixel circuitry can be laid out in a 0.18 μm CMOS process in an area per pixel of less than 144 μm$^2$. Applicants have further found that in this case an SVGA display (having an array of 800×600 pixels) consumes only 61 mW when displaying an all-white image in color sequential mode with each color field displayed twice per frame (and an inverse of each color field also displayed twice per frame to achieve DC balance).

For a 720 Hz video field rate, having a field duration of 1.39 ms, the teaching above with regard to producing a gamma=2 characteristic by variable time intervals between sequence states indicated that the minimum interval would have a duration of 1.39 ms/65025 in the case of 8-bit gray scale. Thus, this interval would have duration of 21 ns, setting the minimum required read time. This compares very favorably with the 7.6 ns read time required in a prior-art quarter-VGA display described above, and even more favorably with the 1.7 ns read time required in a prior-art 1080-line display.

Applicants have found that utilizing the embodiments of the invention described above they could make a VGA (640×480) display that displays two each of red, green, and blue color fields per 60-Hz video frame time (with another two of each used for DC balance, without being illuminated), while needing only 24 data input lines operating at a 25 MHz bus rate, directly accepting standard digital video input and requiring no other ASIC or external memory, They have similarly found that they could make an SVGA (800×600) display that still needed only 24 data input lines, now operating a bus clock rates as low as 30 MHz, easily accommodating the standard clock rate for this resolution of closer to 40 MHz. This can be compared with an SVGA display sold by Texas Instruments under the DLP (Digital Light Processing) brand. Applicants' examination of such a display used in the Mitsubishi PK20 projector revealed that this display had 150 interconnection pins. The DLP panel was connected, via a 90-line flex circuit, to another board with a 564-pin control ASIC and a 32 Mb external frame buffer memory.

In the case of the embodiments of the present invention described with reference to FIGS. 26 and 9, the number of transistors per pixel is even further. Again in the case of the input image data having p bits per pixel, the 1-T register bank circuitry of FIG. 26 would require only 2p transistors (along with 2p capacitors), while the sense amplifier would and associated global column enable and refresh transistors requires nine transistors. Assuming the member of bits in a gray-scale value is p/3, the decision circuit of FIG. 26 requires a further p+6 transistors. Thus, including the ten transistors of the pixel driver of FIG. 9, each pixel of the embodiment of FIG. 26 would require 3p+25 transistors. In the case of p=24, each pixel of the embodiment of FIG. 26 would thus need 97 transistors. The total number of transistors needed per pixel per bit of input image data depth is then less than 5, ranging almost down to 4 for p ranging from, 15 to 25 (i.e. input bits/color ranging from 5 to 8).

Figure 21:
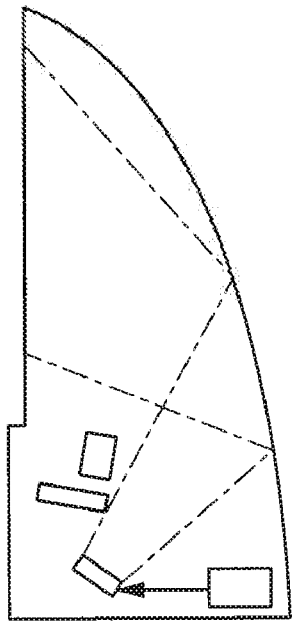
FIG. 21 is a generalized side view of a rear projection display system.
Figure 22:
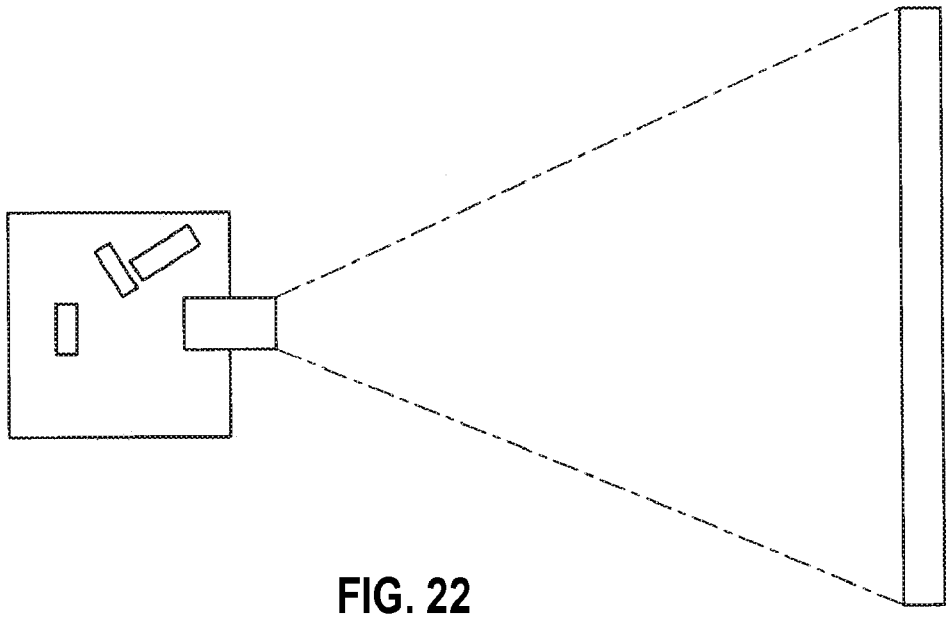
FIG. 22 is a generalized side view of a front projection display system.

While the microdisplay 44 and LCOS display panel 64 have been described thus far in conjunction with the use of a camera 30, it is also possible for the microdisplay 44 and display panel 64 to be used in a rear projection application such as an HDTV as shown in FIG. 21 and a front projection fashion as shown in an HDTV projector as shown in FIG. 22.

The foregoing description has been presented for purposes of illustration and description. Furthermore, the description is not intended to limit the invention to the form disclosed herein. While a number of exemplary aspects and embodiments have been discussed above, those of skill in the art will recognize certain variations, modifications, permutations, additions, and sub-combinations thereof. It is therefore intended that the following appended claims and claims hereafter introduced are interpreted to include all such variations, modifications, permutations, additions, and sub-combinations as are within their true spirit and scope.

What is claimed is:

1. A digital display, comprising:

an array of pixels arranged in rows and columns, each pixel having a selectable optical state; and a plurality of pixel circuits, each pixel circuit associated with a pixel of the array of pixels, each pixel circuit including:

image data registers, the image data registers storing digital image data;

a logic circuit coupled to the image data registers, the logic circuit operable to select and read the digital image data from the image data registers and generate an output signal based on the digital image data and a digital logic signal; and a pixel driver circuit that receives the output signal of the logic circuit and determines the optical state of the associated pixel based at least in part on the output signal;

wherein output nodes of the image data registers are coupled to a central node in the logic circuit through select switches, and wherein a plurality of the image data registers are selected in parallel, the output signal being dependent on a result of a function of digital image data of the plurality of selected image data registers and the digital logic signal.

2. A digital display as defined in claim 1, wherein the image data registers in each pixel circuit include two banks of digital memory registers, and wherein each bank of digital memory registers stores a digital grayscale value for each component color for the associated pixel.

3. A digital display as defined in claim 2, wherein each bank of digital memory registers stores an 8-bit digital grayscale value for each component color for the associated pixel.

4. A digital display as defined in claim 2, wherein digital image data is routed to each bank of digital memory registers in each pixel circuit through local column data signals, wherein the local column data signals are local to each pixel circuit.

5. A digital display as defined in claim 1, wherein the image data registers comprise dynamic memory registers.

6. A digital display as defined in claim 5, wherein each pixel circuit includes sensing and refresh circuitry for each of the dynamic memory registers.

7. A digital display as defined in claim 1, wherein the image data registers store image data as charge on FET transistor gates.

8. A digital display as defined in claim 1, wherein the digital logic signal is coupled to and controls the select switches.

9. A digital display as defined in claim 1, further comprising a column control circuit that drives a plurality of global column data signals, and wherein each pixel circuit includes a switch that selectably routes one of the plurality of global column data signals to a local column signal associated with the pixel group.

10. A digital display as defined in claim 1, wherein the logic circuit reads a plurality of digital image data bits in parallel from the image data registers and the plurality of digital image data bits read by the logic circuit are used at the same time by the logic circuit to determine the output signal.

11. A digital display as defined in claim 10, wherein the output of the logic circuit is dependent on a result of a wired-NOR function of the plurality of digital image data bits read in parallel and the digital logic signal.

12. A digital display as defined in claim 11, wherein each pixel driver circuit selectably sets optical states of the pixels if the result of the wired-NOR function is a high logic state.

13. A digital display as defined in claim 1, wherein the image data registers and the logic circuit of a pixel circuit are used to provide pulse width modulated drive waveforms between a plurality of optical states for each pixel of the array of pixels.

14. A digital display as defined in claim 13, wherein a pixel electrode is driven to a first pixel voltage level at the beginning of a display phase for a component color and driven to a second pixel voltage level at a time dependent on a gray scale image data value for the component color stored in the image data registers.

15. A digital display, comprising:

an array of pixels in rows and columns, each pixel having a selectable optical state determined by a pixel driver circuit associated with the pixel;

image data registers that store digital image data for the array of pixels; and a plurality of logic circuits that each select and read a plurality of the image data registers, the plurality of logic circuits each generating an output signal based on the selected plurality of image data registers and a digital logic signal;

wherein each logic circuit reads a plurality of digital image data bits in parallel from the image data registers and the plurality of digital image data bits read by the logic circuit are used at the same time by the logic circuit to determine the output signal, and wherein the output signal of the logic circuit is dependent on a result of a wired-NOR function of the plurality of digital image data bits read in parallel and the digital logic signal.

16. A digital display as defined in claim 15, wherein the image data registers include two banks of digital memory registers, and wherein each bank of digital memory registers stores a digital grayscale value for each component color for the array of pixels.

17. A digital display as defined in claim 16, wherein each bank of digital memory registers stores an 8-bit digital grayscale value for each component color for the array of pixels.

18. A digital display as defined in claim 16, wherein digital image data is routed to each bank of digital memory registers through local column data signals, wherein the local column data signals are local to each pixel.

19. A digital display as defined in claim 15, wherein the image data registers comprise dynamic memory registers.

20. A digital display as defined in claim 19, wherein each pixel includes sensing and refresh circuitry for the dynamic memory registers.

21. A digital display as defined in claim 15, wherein the image data registers store image data as charge on FET transistor gates.

22. A digital display as defined in claim 21, wherein output nodes of the image data registers are coupled to a central node in the logic circuit through select switches.

23. A digital display as defined in claim 22, wherein the digital logic signal is coupled to and controls the select switches.

24. A digital display as defined in claim 15, further comprising a column control circuit that drives a plurality of global column data signals, and wherein each pixel includes a switch that selectably routes one of the plurality of global column data signals to a local column signal associated with the pixel.

25. A digital display as defined in claim 15, wherein each pixel driver circuit selectably sets optical states of the pixels if the result of the wired-NOR function is a high logic state.

26. A digital display as defined in claim 15, wherein the image data registers and the logic circuits are used to provide pulse width modulated drive waveforms between a plurality of optical states for each pixel of the array of pixels.

27. A digital display as defined in claim 26, wherein a pixel electrode is driven to a first pixel voltage level at the beginning of a display phase for a component color and driven to a second pixel voltage level at a time dependent on a gray scale image data valve for the component color stored in the image data registers.

* * * * *

UNITED STATES PATENT AND TRADEMARK OFFICE

CERTIFICATE OF CORRECTION

PATENT NO. : 8,059,142 B2
APPLICATION NO. : 11/969734
DATED : November 15, 2011
INVENTOR(S) : Mark A. Handschy et al.

It is certified that error appears in the above-identified patent and that said Letters Patent is hereby corrected as shown below:

In column 35, line 53, in Claim 9, delete "group." and insert -- circuit. --, therefor.

Signed and Sealed this
First Day of May, 2012

David J. Kappos

David J. Kappos
*Director of the United States Patent and Trademark Office*